US010364109B2

(12) United States Patent
Hirano et al.

(10) Patent No.: US 10,364,109 B2
(45) Date of Patent: Jul. 30, 2019

(54) FEEDING APPARATUS

(71) Applicant: CANON KABUSHIKI KAISHA, Tokyo (JP)

(72) Inventors: Yuya Hirano, Odawara (JP); Fumiaki Mizuno, Nagoya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/884,709

(22) Filed: Jan. 31, 2018

(65) Prior Publication Data

US 2018/0222705 A1 Aug. 9, 2018

(30) Foreign Application Priority Data

Feb. 8, 2017 (JP) ..... 2017-021297
Dec. 22, 2017 (JP) ..... 2017-246425

(51) Int. Cl.

| | |
|---|---|
| ***B65H 3/06*** | (2006.01) |
| ***G03G 15/00*** | (2006.01) |
| ***B65H 7/02*** | (2006.01) |
| ***B65H 3/52*** | (2006.01) |

(52) U.S. Cl.

CPC ..... *B65H 3/0676* (2013.01); *B65H 3/0669* (2013.01); *B65H 3/5207* (2013.01); *B65H 3/5261* (2013.01); *B65H 7/02* (2013.01); *G03G 15/55* (2013.01); *G03G 15/553* (2013.01); *G03G 15/6511* (2013.01); *B65H 2403/724* (2013.01); *B65H 2403/732* (2013.01); *B65H 2513/11* (2013.01); *B65H 2513/52* (2013.01); *B65H 2601/324* (2013.01)

(58) Field of Classification Search

CPC ..... B65H 3/06; B65H 3/0676; B65H 3/5215; B65H 3/5253; B65H 3/5261; B65H 7/00; B65H 7/02; B65H 7/18

USPC ..... 271/110, 4.1, 122, 125

See application file for complete search history.

(56) References Cited

U.S. PATENT DOCUMENTS

| | | | | |
|---|---|---|---|---|
| 7,591,460 | B2 * | 9/2009 | Ohshima | B65H 7/12 271/110 |
| 9,359,159 | B2 | 6/2016 | Noda et al. | |
| 2001/0024011 | A1 * | 9/2001 | Tamura | B65H 3/5261 271/10.1 |
| 2003/0193126 | A1 * | 10/2003 | Hoberock | B65H 3/0607 271/10.11 |
| 2007/0096385 | A1 * | 5/2007 | Mandel | B65H 3/5261 271/122 |
| 2017/0166411 | A1 | 6/2017 | Kawarago et al. | |
| 2017/0210582 | A1 * | 7/2017 | Okano | B65H 3/06 |

FOREIGN PATENT DOCUMENTS

| | | | |
|---|---|---|---|
| JP | 11-035183 | A | 2/1999 |
| JP | 4176551 | B2 | 11/2008 |
| JP | 2011-184129 | A | 9/2011 |
| JP | 2015-160693 | A | 9/2015 |
| JP | 2017-154829 | A | 9/2017 |

* cited by examiner

*Primary Examiner* — David H Bollinger
(74) *Attorney, Agent, or Firm* — Venable LLP

(57) ABSTRACT

The feeding apparatus includes a pick-up roller, a feed roller, a separation roller which forms a separation nip portion with the feed roller, an encoder, and an engine control unit. The engine control unit obtains variation in rotation speed of the separation roller based on a detection result of the encoder, and determines a life condition of the separation roller based on the obtained variation in rotation speed of the separation roller.

22 Claims, 13 Drawing Sheets

FEEDING APPARATUS

BACKGROUND OF THE INVENTION

Field of the Invention

The present invention relates to a feeding apparatus to perform feeding control for a recording material used in an image forming apparatus, for example, a copying machine or a printer.

Description of the Related Art

Hitherto, an image forming apparatus such as a copying machine or a printer includes a feeding mechanism which is configured to separate recording materials stacked on a sheet-feeding unit and feed the recording materials one after another. Various types of feeding mechanisms have been employed. For example, in Japanese Patent Application Laid-Open No. H11-035183, there is disclosed an image forming apparatus which includes a feeding mechanism of a retard separation type using a separation roller. In the feeding mechanism of the retard separation type, when the number of revolutions of the separation roller is equal to or less than a predetermined value a predetermined number of times in a row, it is determined that the separation roller has reached an end of life. Further, in Japanese Patent No. 4176551, there is disclosed an image forming apparatus having the following configuration. Only a feed roller is driven under a state under which a separation roller is not driven, and the number of revolutions of the separation roller which is given when the separation roller is rotated by rotation of the feed roller is monitored with an encoder. When a phase difference between signals output from the encoder used for the monitoring does not fall within a range of a reference value set in advance, it is notified that the separation roller has caused abrasion.

As the abrasion of the separation roller progresses, the rotation speed of the separation roller becomes more unstable between high rotation speed and low rotation speed. As the abrasion further progresses to degrade conveyance performance of the separation roller, the rotation speed continuously decreases. That is, the unstable state which occurs before the rotation speed of the separation roller continuously decreases is a sign indicating that the separation roller reaches an end of life. According to the conventional type of an apparatus, it can be determined that the separation roller has reached an end of life when the number of revolutions of the separation roller is continuously less than a predetermined value. However, there is difficulty in detecting the above-mentioned sign indicating that the separation roller reaches an end of life. Further, as a diameter of the separation roller decreases due to abrasion along with elapse of use time, the rotation speed of the separation roller increases. After that, as the separation roller is further abraded, the followability with respect to a sheet is further degraded, with the result that the rotation speed of the separation roller gradually decreases with repetition of minute slippage. Therefore, variation in diameter of the separation roller and variation in friction coefficient of a surface of the separation roller at the time of production as well as changes in rotation speed due to abrasion have influence on the detection accuracy.

Further, according to the conventional type of an apparatus, it can be determined whether or not the separation roller has caused abrasion. However, it is required to provide a mechanism which is configured to independently switch the feed roller and the separation roller between drive and non-drive. Further, rotation of the separation roller at the time of conveying one sheet at a separation nip portion changes depending on a kind of the sheet being conveyed. In general, even when the same separation roller is used, the followability of the separation roller with respect to a sheet is further degraded as a friction coefficient of the sheet becomes smaller, with the result that a conveyance defect is liable to occur. According to the conventional type of an apparatus, the number of revolutions of the separation roller which is given when the separation roller is rotated by a friction force of the feed roller is monitored. Therefore, there is difficulty in taking into consideration the influence of a sheet on the conveyance performance.

SUMMARY OF THE INVENTION

An aspect of the present invention is a feeding apparatus which is capable of accurately determining a life condition of a separation roller.

Another aspect of the present invention is a feeding apparatus including a feeding rotary member configured to feed a plurality of recording materials stacked on a stacking portion per a sheet, wherein the feeding rotary member feeds a first recording material provided at an uppermost position in the stacking portion, and feeds a second recording material provided below the first recording material to partially overlap the first recording material after a trailing edge of the first recording material passes through the feeding rotary member, a conveyance rotary member configured to convey each of the plurality of the recording materials fed by the feeding rotary member, a separation rotary member configured to form a nip portion with the conveyance rotary member, wherein in a case where the first recording material is fed to the nip portion, the separation rotary member is rotated in a predetermined direction by the first recording material, and in a case where the first recording material and the second recording material are fed into the nip portion in an overlapping state, the separation rotary member stops in rotation or rotates in a direction opposite to the predetermined direction so as to separate the first recording material and the second recording material, an output unit configured to output a signal according to a rotation state of the separation rotary member, and a control unit configured to control a feeding operation by the feeding rotary member based on a rotation speed of the separation rotary member corresponding to the signal from the output unit, and control the feeding operation in a state where a leading edge of the second recording material reached the nip portion, wherein the control unit determines a life of the separation rotary member based on variation in rotation speed of the separation rotary member corresponding to the signal output from the output unit during a predetermined period in which the separation rotary member is rotated in the predetermined direction under a state in which the first recording material is fed to the nip portion.

A further aspect of the present invention is a feeding apparatus including a feeding rotary member configured to feed a plurality of recording materials stacked on a stacking portion per a sheet, wherein the feeding rotary member feeds a first recording material provided at an uppermost position in the stacking portion, and feeds a second recording material provided below the first recording material to partially overlap the first recording material after a trailing edge of the first recording material passes through the feeding rotary member, a conveyance rotary member configured to convey each of the plurality of the recording materials fed by the feeding rotary member, a separation rotary member configured to form a nip portion with the conveyance rotary member, wherein in a case where the first recording material is fed to the nip portion, the separation rotary member is rotated in a predetermined direction by the first recording material, and in a case where the first recording material and the second recording material are fed into the nip portion in an overlapping state, the separation rotary member stops in rotation or rotates in a direction opposite to the predetermined direction so as to separate the first recording material and the second recording material, an output unit configured to output a signal according to a rotation state of the separation rotary member, and a control unit configured to control a feeding operation by the feeding rotary member based on a rotation speed of the separation rotary member corresponding to the signal from the output unit, and control the feeding operation in a state where a leading edge of the second recording material reached the nip portion, wherein the control unit determines a life of the separation rotary member based on the rotation speed of the separation rotary member corresponding to the signal output from the output unit.

Further features of the present invention will become apparent from the following description of exemplary embodiments with reference to the attached drawings.

DESCRIPTION OF THE EMBODIMENTS

Modes for carrying out the present invention are described below in detail based on embodiments with reference to the drawings.

First Embodiment

<Description of Configuration of Image Forming Apparatus>

Figure 1:
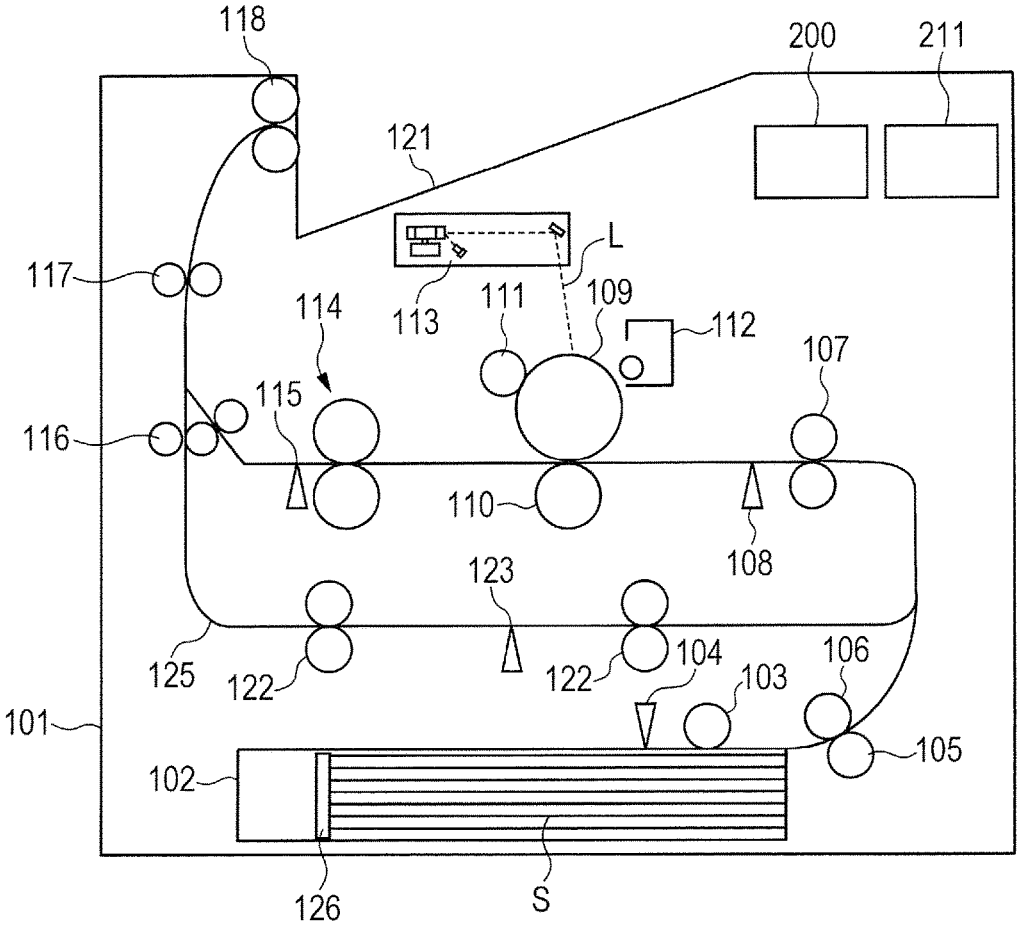
FIG. 1 is a configuration view of an image forming apparatus in a first embodiment and a second embodiment of the present invention.

A feeding apparatus of a first embodiment of the present invention is a feeding apparatus that is used for a laser beam printer 101 (hereinafter referred to as "printer 101") of an electrophotographic type being an image forming apparatus. FIG. 1 is a schematic configuration view of the printer 101. A cassette 102 is a storage portion configured to store sheets S being recording materials, and is removably mounted to a main body of the printer 101. The cassette 102 is also referred to as a stacking portion in which the sheets S are stacked. A trailing edge regulation plate 126 provided to the cassette 102 is configured to regulate a trailing edge of the sheet S stored in the cassette 102. The trailing edge of the sheet S corresponds to an end portion of the sheet S on an upstream side in a feeding direction of the sheet S. The trailing edge regulation plate 126 is movable in the feeding direction, and is adjusted to a suitable position for a size (length in the feeding direction) of the sheet S so that the sheet S is set at an appropriate position.

Under a state under which the cassette 102 is mounted to the main body of the printer 101, a pick-up roller 103 (hereinafter referred to as "pick roller 103") being a feeding rotary member feeds the sheet S stored in the cassette 102. The sheet S fed by the pick roller 103 is further fed by a feed roller 106 being a conveyance rotary member to a downstream side in a conveyance direction of the sheet S. Then, the sheet S arrives at a top sensor 108 through a registration roller pair 107. A separation roller 105 being a separation rotary member forms a separation nip portion with the feed roller 106 so as to prevent a plurality of (two or more) sheets S from being fed together to the downstream side of the separation nip portion. An operation of the separation roller 105 is described in detail later. With this configuration, among the sheets S stored in the cassette 102, only a sheet S that is provided at an uppermost position in a direction orthogonal to a bottom surface of the cassette 102 is fed to the registration roller pair 107.

The sheet S having been detected by the top sensor 108 being a detection unit is then conveyed to an image forming unit. The image forming unit includes a photosensitive drum 109, a charge roller 111, a laser scanner 113, a developing device 112, a transfer roller 110, and a fixing device 114. The photosensitive drum 109 is uniformly charged by the charge roller 111 and thereafter is irradiated with laser light L by the laser scanner 113 so that an electrostatic latent image is formed on a surface of the photosensitive drum 109. The electrostatic latent image formed in such a manner is formed into a visible toner image by supply of toner from the developing device 112. The photosensitive drum 109 and the transfer roller 110 form a transfer nip portion, and the sheet S is conveyed to the transfer nip portion in synchronization with rotation of the photosensitive drum 109. The toner image formed on the photosensitive drum 109 is transferred to the sheet S at the transfer nip portion. For the transfer of the toner image, a voltage having a polarity which is opposite to that of the toner image is applied to the transfer roller 110. The sheet S having the toner image transferred thereon is conveyed to the fixing device 114, and is heated and pressurized by the fixing device 114. As a result, the unfixed toner image having been transferred to the sheet S is fixed to the sheet S. The sheet S having the toner image fixed thereto is conveyed by triple rollers 116, intermediate delivery rollers 117, and delivery rollers 118, and is delivered to a delivery tray 121. With the above-mentioned operations, a series of printing operations is ended.

When printing is to be performed on both surfaces of the sheet S, the sheet S having been subjected to printing on one surface thereof is not delivered to the delivery tray 121. The triple rollers 116, the intermediate delivery rollers 117, and the delivery rollers 118 are reversely rotated after the trailing edge of the sheet S passes through the triple rollers 116. The sheet S is conveyed to a duplex printing conveyance passage 125, and is further conveyed to the image forming unit again by duplex printing conveyance rollers 122. With this operation, printing can be performed on both surfaces of the sheet S.

In FIG. 1, a fixing delivery sensor 115 and a duplex printing conveyance sensor 123 are provided for determination of whether or not the sheet S is conveyed in a normal state. Further, a sheet presence sensor 104 is provided for detection of whether or not the sheet S is stored in the cassette 102. An operation panel 211 (hereinafter referred to as "panel 211") being a display unit is provided to the printer 101, and displays various kinds of information for a user. The printer 101 includes a control unit 200. Now, the control unit 200 is described in detail.

<Control Unit>

Figure 2:
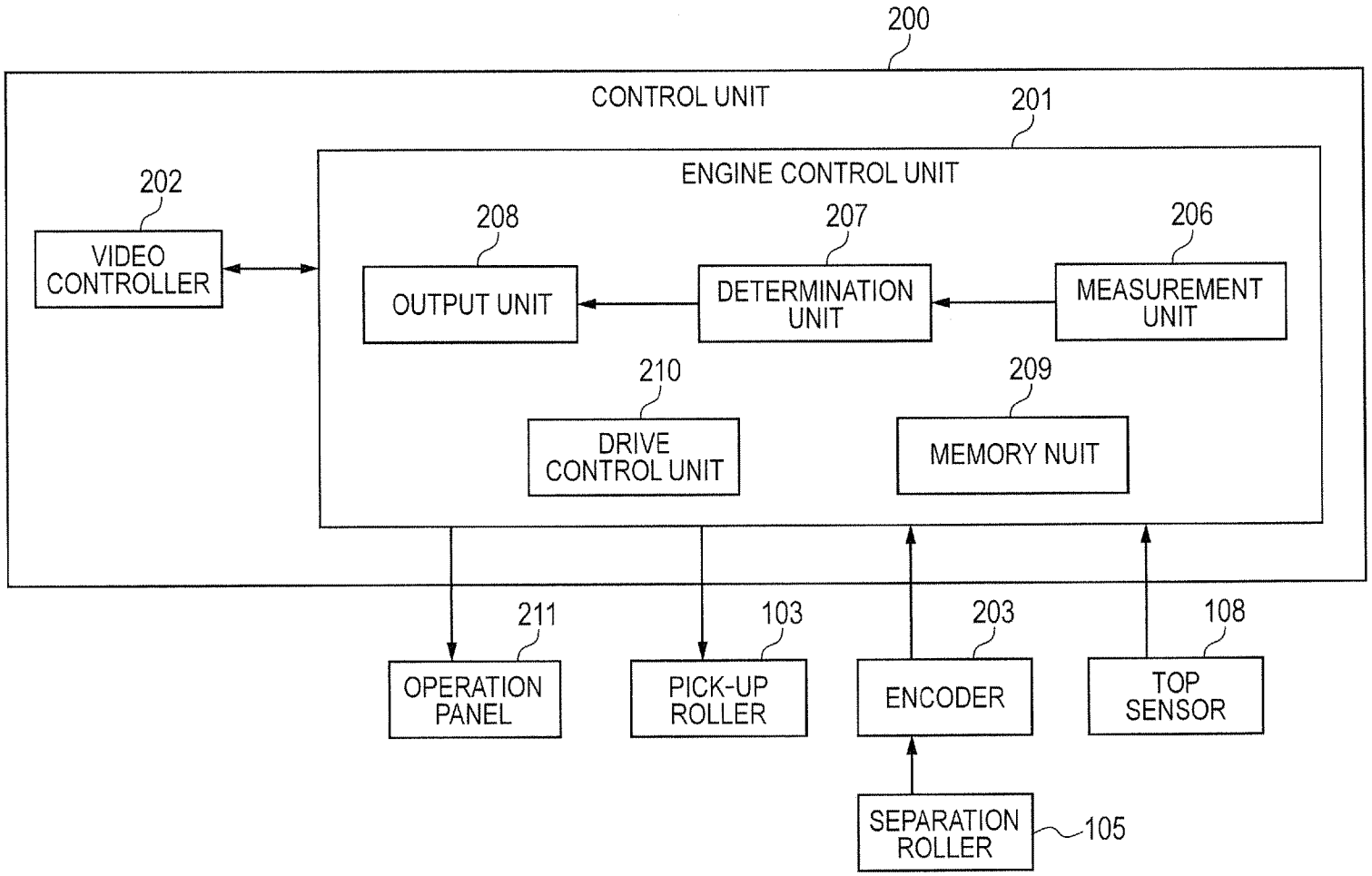
FIG. 2 is a control block diagram of the image forming apparatus in the first embodiment and the second embodiment.

FIG. 2 is a block diagram of the control unit 200 of the printer 101. The control unit 200 includes an engine control unit 201 and a video controller 202, and the above-mentioned printing operation is achieved through mutual communication between the engine control unit 201 and the video controller 202. When a print instruction is given by external equipment (not shown) such as a personal computer, the video controller 202 performs analysis of image data, and the engine control unit 201 controls mechanisms of the printer 101 based on results of the analysis. The engine control unit 201 includes a measurement unit 206, a determination unit 207, an output unit 208, a memory unit 209, and a drive control unit 210. The measurement unit 206 measures elapsed time from start of feeding of the sheet S by the pick roller 103. Further, the measurement unit 206 measures the rotation speed of the separation roller 105 based on a rotation state of the separation roller 105 which is detected by an encoder 203. The measurement unit 206 outputs information of the measured time and information of the measured rotation speed of the separation roller 105 to the determination unit 207.

The determination unit 207 performs life condition determination for the separation roller 105 based on the rotation speed of the separation roller 105 which has been measured by the measurement unit 206. The determination unit 207 outputs a result of the determination to the output unit 208. The output unit 208 notifies information related to a life of the separation roller 105, which has been output from the determination unit 207, to a user through the panel 211 or external equipment. The memory unit 209 stores, for example, information of a print request given by the video controller 202 and time measured in the past by the measurement unit 206. The drive control unit 210 controls activation and stoppage of the feeding mechanism in accordance with detection results of various sensors (described later).

Further, the encoder 203, which is an output unit configured to output a signal in accordance with a rotation state of the separation roller 105, and the top sensor 108 are connected to the engine control unit 201. The drive control unit 210 uses detection results of those sensors to control drive of the pick roller 103. As the encoder 203, for example, a code wheel which is provided so as to be coaxial with the separation roller 105 is used. Further, depending on a required accuracy and a place of arrangement, another encoder such as an optical rotary encoder, a magnetic rotary encoder, or a photo-interrupter can be used. Further, the panel 211 through which the output unit 208 outputs information is connected to the engine control unit 201.

Figure 3:
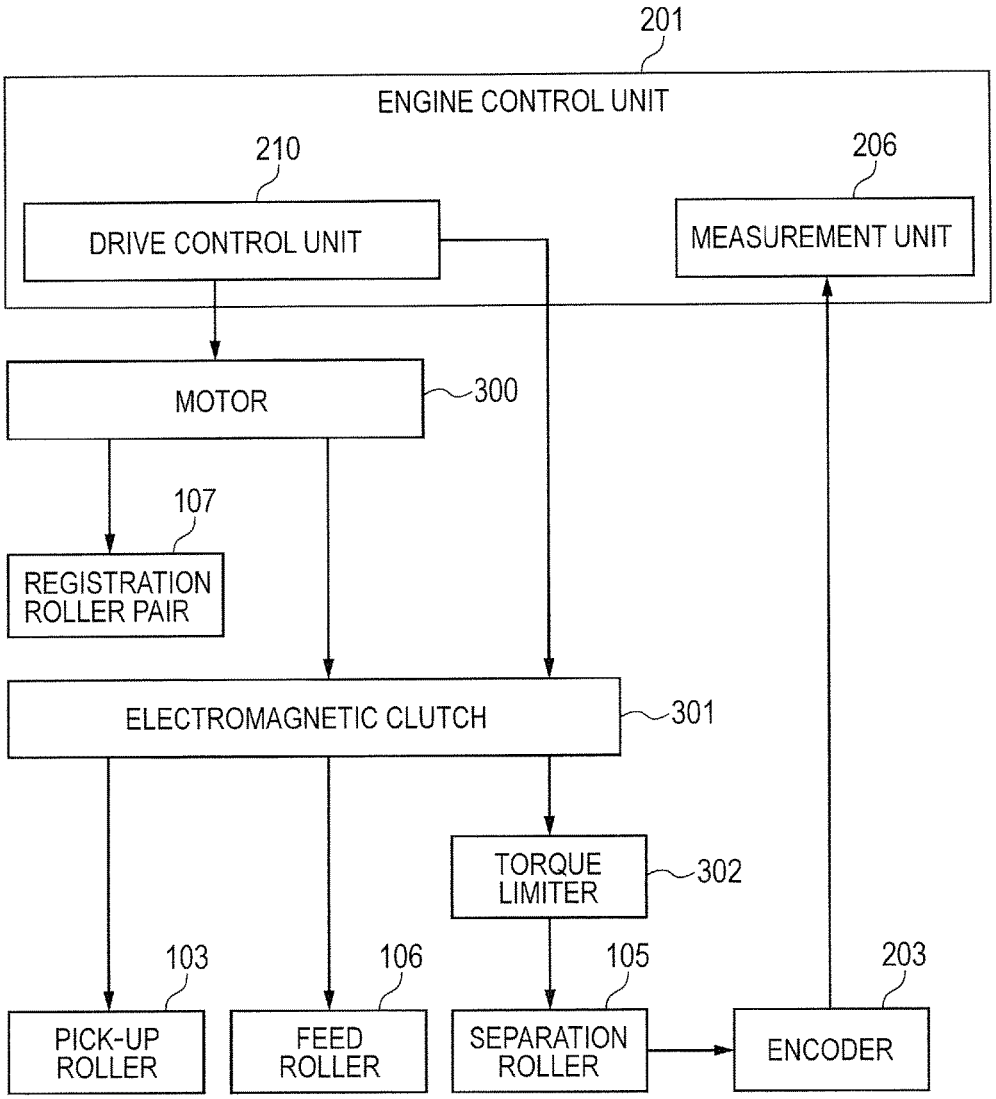
FIG. 3 is a control block diagram of the image forming apparatus in the first embodiment and the second embodiment.

FIG. 3 is a block diagram for illustrating the feeding mechanism in detail. In FIG. 3, a motor 300 is a drive source which is configured to drive the pick roller 103, the feed roller 106, the separation roller 105, and the registration roller pair 107. An electromagnetic clutch 301 transmits or cuts a drive force of the motor 300 applied to the pick roller 103, the feed roller 106, and the separation roller 105. The drive control unit 210 is capable of switching ON/OFF states of drive with respect to members by controlling the motor 300 and the electromagnetic clutch 301. Although detailed description is made later, drive in a direction of feeding the sheet S is transmitted to the pick roller 103 and the feed roller 106, whereas drive in a direction of hindering feeding of the sheet S is transmitted to the separation roller 105. Further, a torque limiter 302 is provided between the electromagnetic clutch 301 and the separation roller 105. The above-mentioned encoder 203 is provided to the printer 101 for the purpose of detecting the rotation state of the separation roller 105, and information detected by the encoder 203 is input to the measurement unit 206. The information detected by the encoder 203 includes, for example, the rotation speed of the separation roller 105, that is, the number of revolutions of the separation roller 105 per unit time. In the first embodiment, as an example of the separation roller 105, description is made of a so-called retard roller to which drive in the direction of hindering feeding of the sheet S is transmitted. However, a roller to which drive is not transmitted is also applicable.

<Description of Sheet Feeding Control>

Figure 4A:
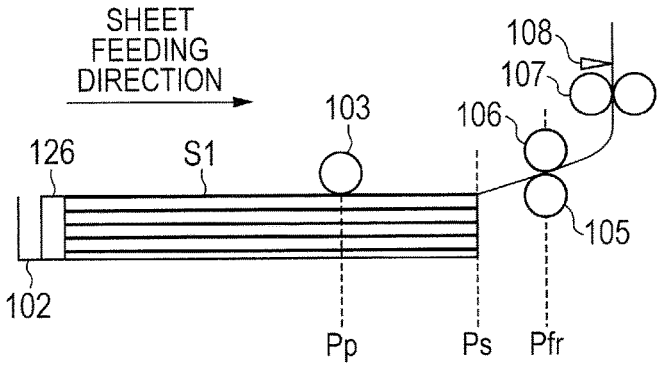
FIG. 4A, FIG. 4B, FIG. 4C, and FIG. 4D are explanatory views for illustrating an operation of sheet feeding control in the first embodiment.

Next, sheet feeding control of the printer 101 in the first embodiment is described with reference to FIG. 4A to FIG. 4D and FIG. 5. In FIG. 4A to FIG. 4D, the conveyance passage from the separation nip portion to the top sensor 108 is depicted with a shape different from that of FIG. 1. However, such difference in depiction is made for easy understanding, this similarly applies to drawings of another embodiment which correspond to FIG. 4A to FIG. 4D. FIG. 4A is a sectional view for illustrating the cassette 102 at a timing at which a sheet S1 stored in the cassette 102 and provided at an uppermost position is fed. When the sheet feeding control is started, the pick roller 103, the feed roller 106, and the separation roller 105 are rotated, and the sheet S1 is fed in a rightward direction (sheet feeding direction) in FIG. 4A. The start of the sheet feeding control corresponds to an operation in which the drive control unit 210 causes the motor 300 to rotate and turns on the electromagnetic clutch 301 to allow a drive force of the motor 300 to be transmitted to the pick roller 103, the feed roller 106, and the separation roller 105.

Figure 5:
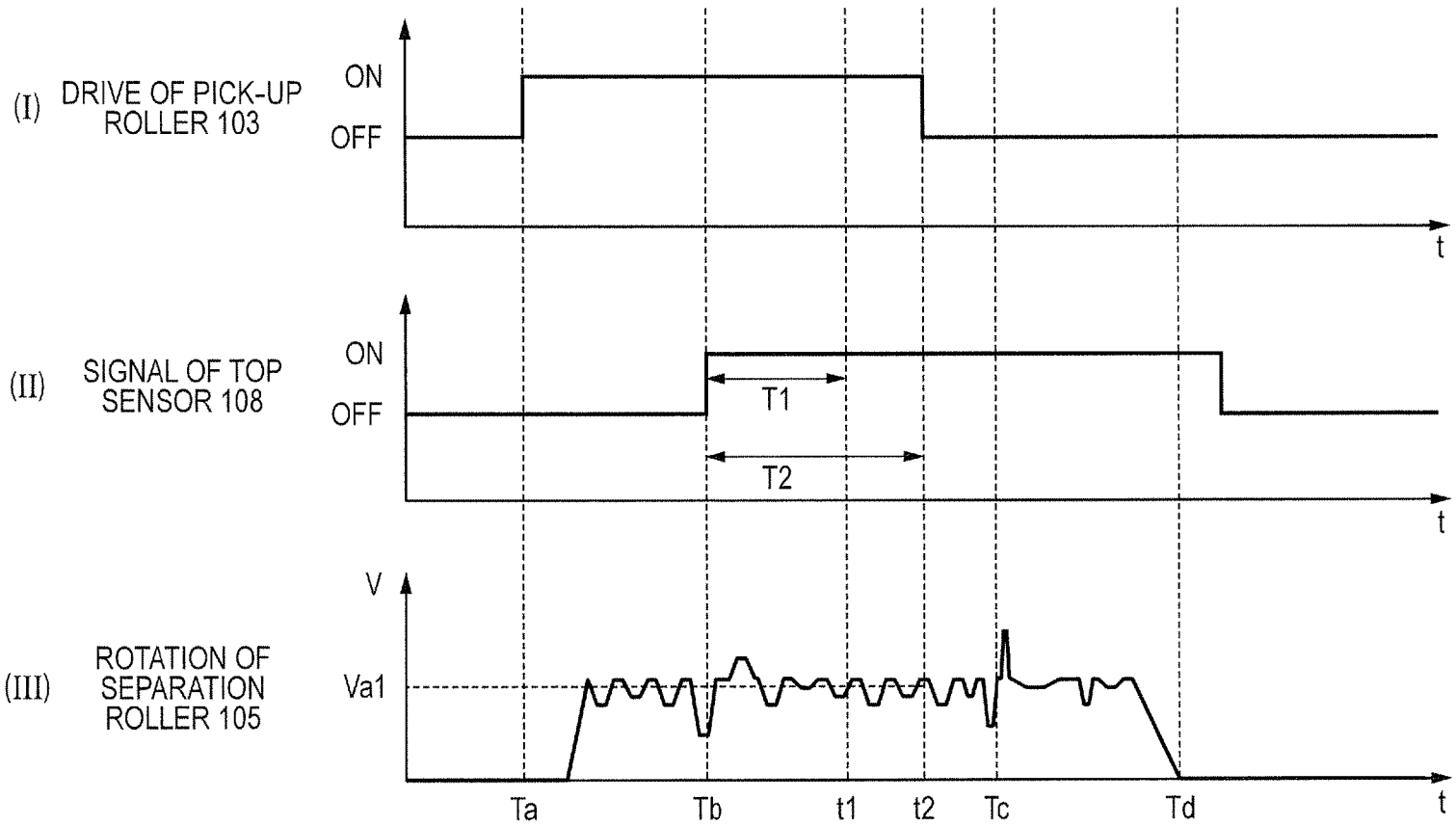
FIG. 5 is a timing chart of a case in which the sheet feeding control in the first embodiment is executed.

A horizontal axis of each graph of FIG. 5 represents an elapsed time t. A vertical axis of a graph (I) of FIG. 5 represents ON and OFF (ON/OFF) states of the drive of the pick roller 103. A vertical axis of a graph (II) of FIG. 5 represents a signal waveform (ON and OFF) of the top sensor 108. A vertical axis of a graph (III) of FIG. 5 represents a rotation speed V of the separation roller 105.

The rotation speed Va1 is described later. A timing Ta in FIG. 5 corresponds to the state illustrated in FIG. 4A. At the timing Ta, drive of the pick roller 103 is switched from OFF to ON, and thereafter the separation roller 105 starts rotation. In FIG. 4A, a position Ps is a leading edge position of the sheet S which is positioned by the trailing edge regulation plate 126. The leading edge of the sheet S corresponds to an end portion of the sheet S on a downstream side in the feeding direction of the sheet S. A position Pp is a position at which the pick roller 103 is brought into abutment against the sheet S (nips the sheet). A position Pfr is a position of the separation nip portion formed by the feed roller 106 and the separation roller 105.

Drive in the direction of hindering feeding of the sheet S (counterclockwise direction in FIG. 4A) is transmitted to the separation roller 105, and the torque limiter 302 (illustrated in FIG. 3) is provided. When the feed roller 106 starts rotation in the direction of feeding the sheet S (counterclockwise direction in FIG. 4A), the torque limiter 302 causes the separation roller 105 to operate as follows. A force which is received by the separation roller 105 due to friction with the feed roller 106 is set so as to overcome a rotation load of the torque limiter 302 when the sheet S is not present at the separation nip portion. Therefore, the separation roller 105 is rotated in the direction of feeding the sheet S (clockwise direction in FIG. 4A). A force which is received by the separation roller 105 due to friction with the one sheet S is set so as to overcome the rotation load of the torque limiter 302 when one sheet S is conveyed to the separation nip portion. Therefore, the separation roller 105 is driven to rotate in the direction of feeding the sheet S, which is a predetermined direction. Meanwhile, the rotation load of the torque limiter 302 is set so as to overcome a conveyance force of the sheets S when two or more sheets S are conveyed to the separation nip portion. Therefore, the separation roller 105 stops due to counteraction of the conveyance force and the rotation load, or starts rotation in the direction of hindering sheet feeding, which is a direction opposite to the predetermined direction, with the rotation load of the torque limiter 302 which overcomes the conveyance force.

Figure 4B:
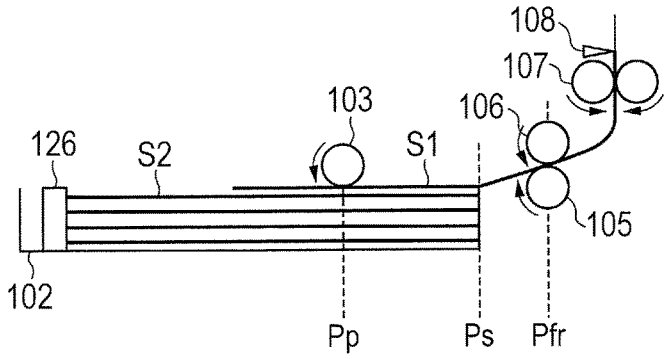

Next, FIG. 4B is a sectional view for illustrating the cassette 102 at a timing at which the leading edge of the sheet S1 has arrived at the registration roller pair 107 and the top sensor 108. A timing Tb in each graph of FIG. 5 corresponds to the state illustrated in FIG. 4B. At the timing Tb, after the leading edge of the sheet S1 is brought into contact with the registration roller pair 107, the sheet S1 is conveyed by the registration roller pair 107. At this time, the conveyance speed of the sheet S1 may be changed due to vibration caused by the contact with the registration roller pair 107 or due to transmission of the conveyance force from the registration roller pair 107 to the sheet S1. Thus, the rotation of the separation roller 105 which is driven to rotate by the sheet S1 may also be changed as indicated by the timing Tb in the graph (III) of FIG. 5.

Figure 4C:
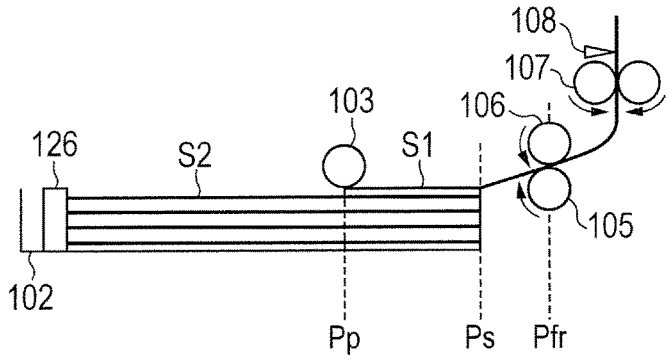

Next, FIG. 4C is a sectional view for illustrating the cassette 102 at a timing at which the trailing edge (on the upstream side in the sheet feeding direction) of the sheet S1 has arrived at the position Pp of the nip portion of the pick roller 103. In the printer 101, in order to prevent the sheet S2 from being pushed into the separation nip portion and causing a sheet jam, the following control is performed. That is, before the sheet S1 arrives at the position Pp of the nip portion of the pick roller 103, drive of the pick roller 103 is switched from ON to OFF at the timing t2. The switching of drive of the pick roller 103 from ON to OFF corresponds to a state under which, while rotation of the motor 300 is continued, the drive control unit 210 switches the electromagnetic clutch 301 from ON to OFF to cut the drive force of the motor 300. The timing t1 is described later.

Further, at this time, drive of the feed roller 106 which is driven by the same drive source as the pick roller 103 is also turned OFF. However, the sheet S1 is conveyed in the sheet feeding direction by the registration roller pair 107, and hence the feed roller 106 and the separation roller 105 are also driven to rotate so as to follow the sheet S1. The timing Tc in FIG. 5 corresponds to the state illustrated in FIG. 4C. The drive of the pick roller 103 has been switched from ON to OFF at the timing t2, but the separation roller 105 is continuously driven to rotate so as to follow the sheet S1 being conveyed by the registration roller pair 107. Further, when the sheet S1 passes through the position Pp of the nip portion of the pick roller 103, the friction force applied by the pick roller 103 to the sheet S1 is eliminated. Therefore, there is a case in which vibration occurs in the sheet S1, and rotation of the separation roller 105 is changed as shown in the graph (III) of FIG. 5.

Figure 4D:
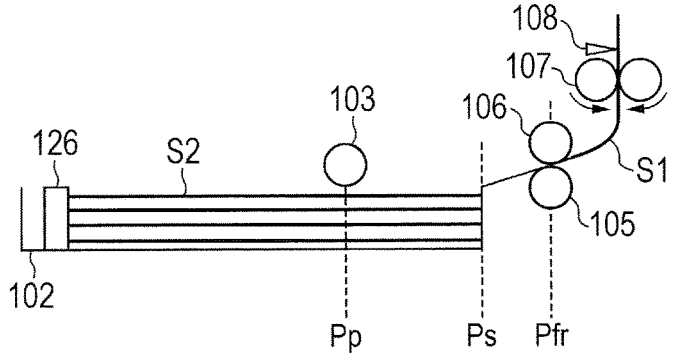

Next, FIG. 4D is a sectional view for illustrating the cassette 102 at a timing at which the trailing edge of the sheet S1 has passed through a position Pfr of the separation nip portion between the feed roller 106 and the separation roller 105. The timing Td in each graph of FIG. 5 corresponds to the state illustrated in FIG. 4D. The sheet S1 has passed through the position Pfr of the separation nip portion, and hence rotation of the feed roller 106 and the separation roller 105 is stopped. The sheet S1 is conveyed to the downstream side in the sheet feeding direction by the registration roller pair 107. Further, after the trailing edge of the sheet S1 passes through the top sensor 108, a signal of the top sensor 108 is changed from ON to OFF.

<Life Detection for Separation Roller>

Next, with reference to FIG. 6A to FIG. 6C and FIG. 7, description is made of a change in rotation speed of the separation roller 105 along with degradation of the conveyance performance of the separation roller 105 due to abrasion. Graphs (I) to (III) of each of FIG. 6A(a), FIG. 6B(a), and FIG. 6C(a) are graphs similar to the graphs (I) to (III) of FIG. 5. In those drawings, there are shown ON and OFF states of the pick roller 103 and the top sensor 108 and the rotation speed of the separation roller 105, which correspond to the total numbers P1 to P3 of fed sheets by the separation roller 105 described later with reference to FIG. 7, in a case in which one sheet S is fed in accordance with the sheet feeding control illustrated in FIG. 4A to FIG. 4D. An average value of the rotation speed of the separation roller 105 in a preset period from the timing t1 to the timing t2 is indicated by Va1. In such a manner, the average value Va1 between the timing t1 and the timing t2 can be acquired each time one sheet S is fed, thereby being capable of acquiring one data each time one sheet S is fed.

The period for obtaining the average value Va1 of the rotation speed of the separation roller 105 is set so as to avoid timings at which the rotation of the separation roller 105 is liable to change, such as the timing Tb and the timing Tc described above. In the first embodiment, the period for obtaining the average value Va1 is set to a period in which, after the leading edge of the sheet S having been fed enters the registration roller pair 107, the separation roller 105 is driven to rotate by the sheet S being conveyed in the sheet feeding direction by the registration roller pair 107. The timing t1 set in advance is a start timing of the period for obtaining the average value Va1, and is set so that the average value Va1 can be obtained while avoiding the timing at which the rotation of the separation roller 105 is liable to change. A time period from the arrival of the leading edge of the sheet S at the top sensor 108 to the timing t1 is referred to as a time period T1, and a time period from the arrival of the leading edge of the sheet S at the top sensor 108 to the timing t2 is referred to as a time period T2 (see FIG. 5).

Figure 6A:
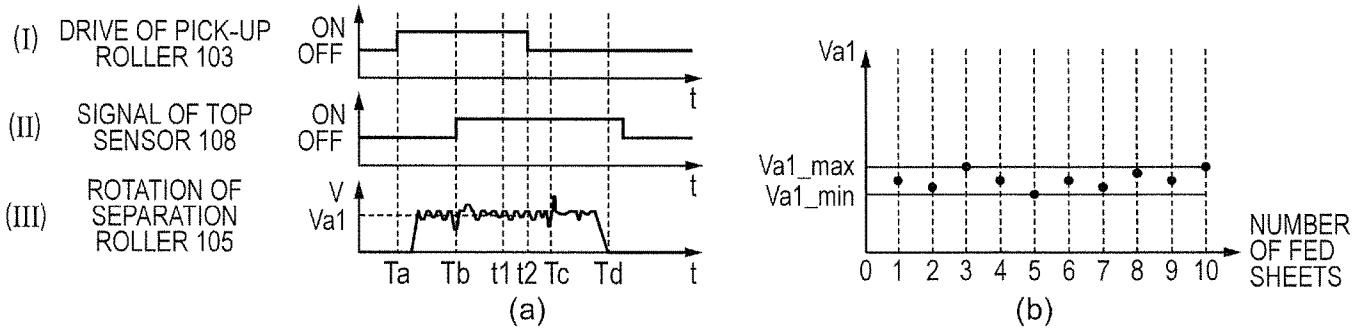
FIG. 6A, FIG. 6B, and FIG. 6C are graphs for showing rotation of the separation roller with total numbers P1, P2, and P3 of fed sheets in the first embodiment.
Figure 7:
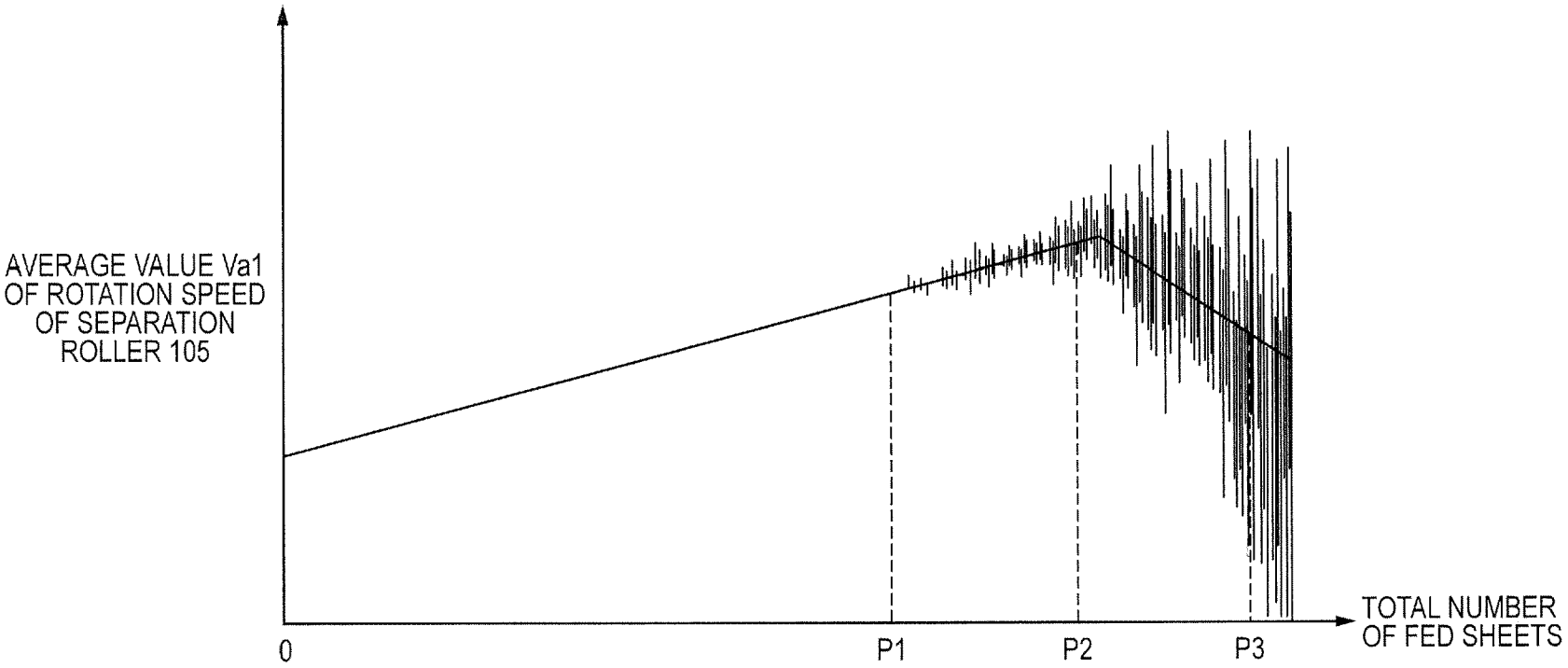
FIG. 7 is a graph for showing a relationship between the total number of fed sheets and the rotation speed of the separation roller in the first embodiment.

In the graph of FIG. 7, the horizontal axis represents the total number of fed sheets, and the vertical axis represents the average value Va1 of the rotation speed of the separation roller 105. A diameter of the separation roller 105 decreases due to abrasion as the total number of fed sheets increases, and thus the rotation speed of the separation roller 105 gradually increases up to the predetermined number of fed sheets. FIG. 6A is a graph for showing rotation of the separation roller 105 when the total number of fed sheets is P1 in FIG. 7. As shown in FIG. 6A(a), the rotation speed of the separation roller 105 being driven to rotate by the sheet S at the time when the total number of fed sheets is P1 is relatively stable as is at the time when the separation roller 105 is new. The average value Va1 of the rotation speed of the separation roller 105 is larger than that given at the time when the separation roller 105 is new because the diameter of the separation roller 105 decreases due to abrasion. In FIG. 6A(b), there is shown variation in average values Va1 of the rotation speed of the separation roller 105 when ten sheets S are fed. In FIG. 6A(b), the horizontal axis represents the number of fed sheets, and the vertical axis represents the average value Va1 of the rotation speed of the separation roller 105. When ten sheets S are fed, ten data can be acquired as the average values Va1 of the rotation speed of the separation roller 105. A maximum value of the ten average values Va1 is indicated by Va1_max, and a minimum value is indicated by Va1_min. In such a manner, a difference between the maximum value Va1_max and the minimum value Va1_min of the average values Va1 of the separation roller 105 can be considered as variation in average values Va1 of the rotation speed of the separation roller 105. As shown in FIG. 6A(a), at the time when the total number of fed sheets is P1, the rotation speed of the separation roller 105 during conveyance of the sheets S is stable. Therefore, variation in average values Va1 of the rotation speed of the separation roller 105 for each sheet feeding during a predetermined period from the timing t1 to the timing t2 (period of T2−T1) is also small as is at the time when the separation roller 105 is new.

Figure 6B:
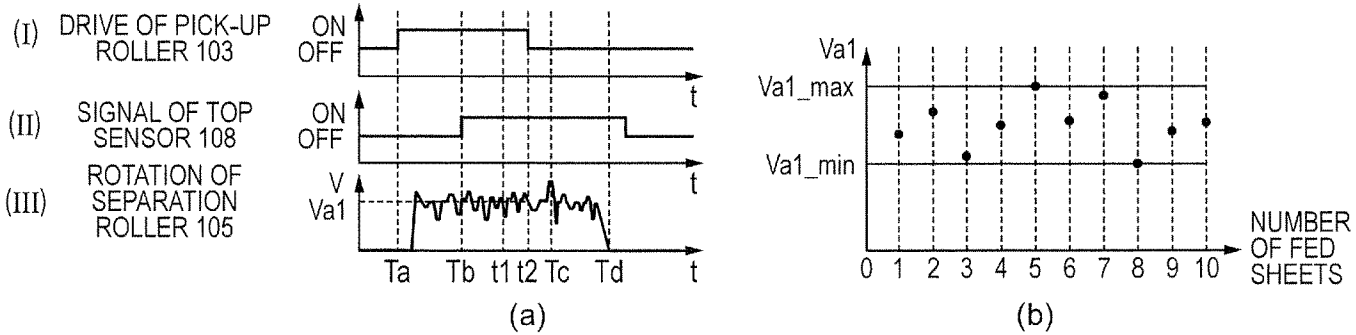

FIG. 6B is a graph for showing rotation of the separation roller 105 when the total number of fed sheets is P2 in FIG. 7. When the total number of fed sheets increases from P1 to P2, abrasion of the separation roller 105 further increases, and thus the average value Va1 of the rotation speed of the separation roller 105 further increases as compared to that given at the time when the total number of fed sheets is P1. Meanwhile, factors such as abrasion of the roller and adhesion of paper powder generated from the sheet S which change the surface state of the separation roller 105 cause decrease in friction force with respect to the sheet S. In such a state, the separation roller 105 cannot be driven to rotate so as to follow the sheet S being conveyed in the sheet feeding direction. As shown in FIG. 6B(a), occurrence of significant changes in rotation speed due to minute slippage of the separation roller 105 with respect to the sheet S starts. The significant changes in rotation speed of the separation roller 105 due to minute slippage causes variation in average values Va1 of the rotation speed of the separation roller 105, that is, causes the difference between the maximum value Va1_max and the minimum value Va1_min to be larger than that given at the time when the total number of fed sheets is P2.

FIG. 6B(b) is a graph similar to the graph of FIG. 6A(b). As shown in FIG. 6B(b), the variation in average values Va1 of the separation roller 105 is larger as compared to that in a period of from zero to P1 in total number of fed sheets. When the total number of fed sheets is P2, the life condition of the separation roller 105 is a condition within a life, which is not at a level at which conveyance defect caused by degradation in conveyance performance frequently occurs. The condition of the separation roller 105 as in the case with the total number of fed sheets being P2 is referred to as a life condition Low level.

Figure 6C:
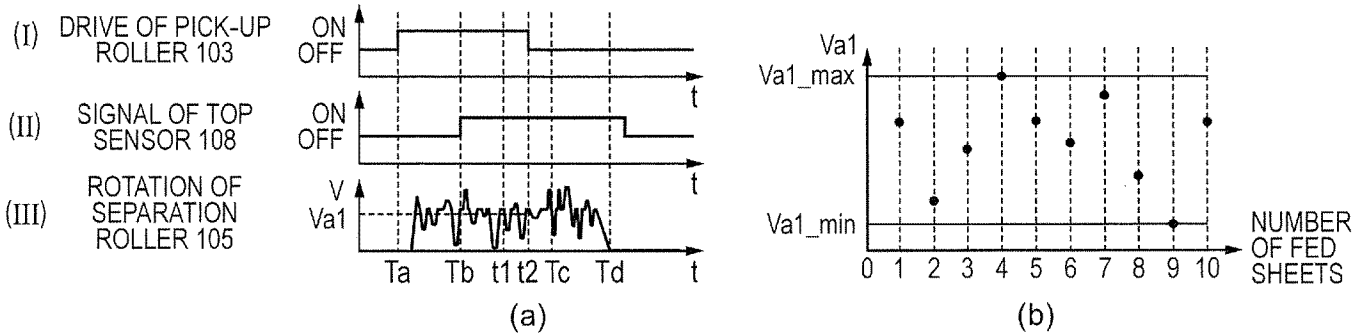

FIG. 6C is a graph for showing rotation of the separation roller 105 when the total number of fed sheets is P3 in FIG. 7. When the total number of fed sheets increases from P2 to P3, abrasion of the separation roller 105 and adhesion of paper powder further increase, and thus the friction force of the separation roller 105 with respect to the sheet S significantly decreases, with the result that the conveyance performance is degraded. Consequently, the separation roller 105 cannot be correctly driven to rotate with respect to the sheet S. Then, as shown in FIG. 6C(a), the rotation speed significantly decreases or significantly changes during conveyance of the sheet S. In some cases, the rotation load of the torque limiter 302 overcomes the force received by the separation roller 105 due to friction with the sheet S, with the result that the separation roller 105 is stopped or rotated in the direction of hindering the sheet feeding.

Meanwhile, the average value Va1 of the rotation speed of the separation roller 105 is smaller than that given at the time when the total number of fed sheets by the separation roller 105 is P2. With this, the rotation speed of the separation roller 105 may be higher, or may be lower than that given at the time when the separation roller 105 is new due to the influence of decreased friction force of the separation roller 105. At this time, as shown in FIG. 6C(b), variation in average values Va1 of the rotation speed of the separation roller 105 is larger as compared to the case in which the number of fed sheets is less than P2. FIG. 6C(b) is a graph similar to the graph of FIG. 6A(b). At this time, the life condition of the separation roller 105 is a condition of having reached an end of life of the separation roller 105 in which conveyance defect caused by degradation in conveyance performance frequently occurs. Such a condition of the separation roller 105 is referred to as a life condition Out level.

Thus, through observation of variation in average values Va1 of the rotation speed of the separation roller 105, the life condition of the separation roller 105 can be determined. Further, through observation of variation in average values Va1 of the rotation speed of the separation roller 105, a sign indicating that the separation roller 105 reaches an end of life (life condition Low level) can be accurately detected. This similarly applies to the case in which the rotation speed of the separation roller 105 is higher than that given at the time when the separation roller 105 is new due to the influence of decrease in diameter of the separation roller 105 as in the case in which the life condition of the separation roller 105 is at the Low level shown in FIG. 6B.

As compared to the method of determining a life condition of the separation roller 105 based on determination of whether or not the rotation speed of the separation roller 105 is lower than a preset threshold value, the method of determining a life condition of the separation roller 105 based on variation in rotation speed of the separation roller 105 can be less affected by the influence such as variation in environment and components. Even when the average rotation speed of the separation roller 105 differs due to variation in environment such as temperature and humidity and components, through actual observation of a magnitude in variation indicating stability of the separation roller 105 in performance of following the sheet S, the influence of the difference in average rotation speed can be minimized.

Further, depending on a kind of the sheet S, for example, a friction coefficient of a surface of a sheet and a weight may differ, with the result that the behavior in rotation speed of the separation roller 105 changes. In order to take into consideration the influence thereof, rotation of the separation roller 105 during a period in which the separation roller 105 is driven to rotate by friction with the sheet S, rather than a period in which the separation roller 105 is rotated by the feed roller 106, is monitored. With this, while taking into consideration the influence of a kind of sheet on the conveyance performance, the life condition of the separation roller 105 can be determined more accurately.

Further, according to comparison between a state under which the separation roller 105 and the feed roller 106 are held in contact with each other and a state under which one sheet is conveyed between the separation roller 105 and the feed roller 106, the separation roller 105 is more liable to slip in the latter state. Therefore, as compared to the method of determining a life condition of the separation roller 105 based on the rotation speed of the separation roller 105 during a period in which the separation roller 105 is rotated while the separation roller 105 and the feed roller 106 are held in contact with each other, a sign indicating that the separation roller 105 reaches an end of life can be detected in an earlier stage by the method in the first embodiment.

Further, with the method of determining a life condition of the separation roller 105 based on the rotation speed of the separation roller 105 during a period in which the separation roller 105 is rotated while the separation roller 105 and the feed roller 106 are held in contact with each other, a sign indicating that the separation roller 105 reaches an end of life cannot be detected in an early stage, with the result that there is a possibility of causing conveyance defect when a sheet having a small friction coefficient is conveyed. According to the first embodiment, the detection is performed under a state under which a sheet is actually conveyed. Therefore, even when any of a sheet having a small friction coefficient and a sheet having a large friction coefficient is conveyed, a sign indicating that the separation roller 105 reaches an end of life can be detected in an early stage so as to prevent occurrence of the conveyance defect in the future.

<Determination Processing for Life Condition>

Figure 8:
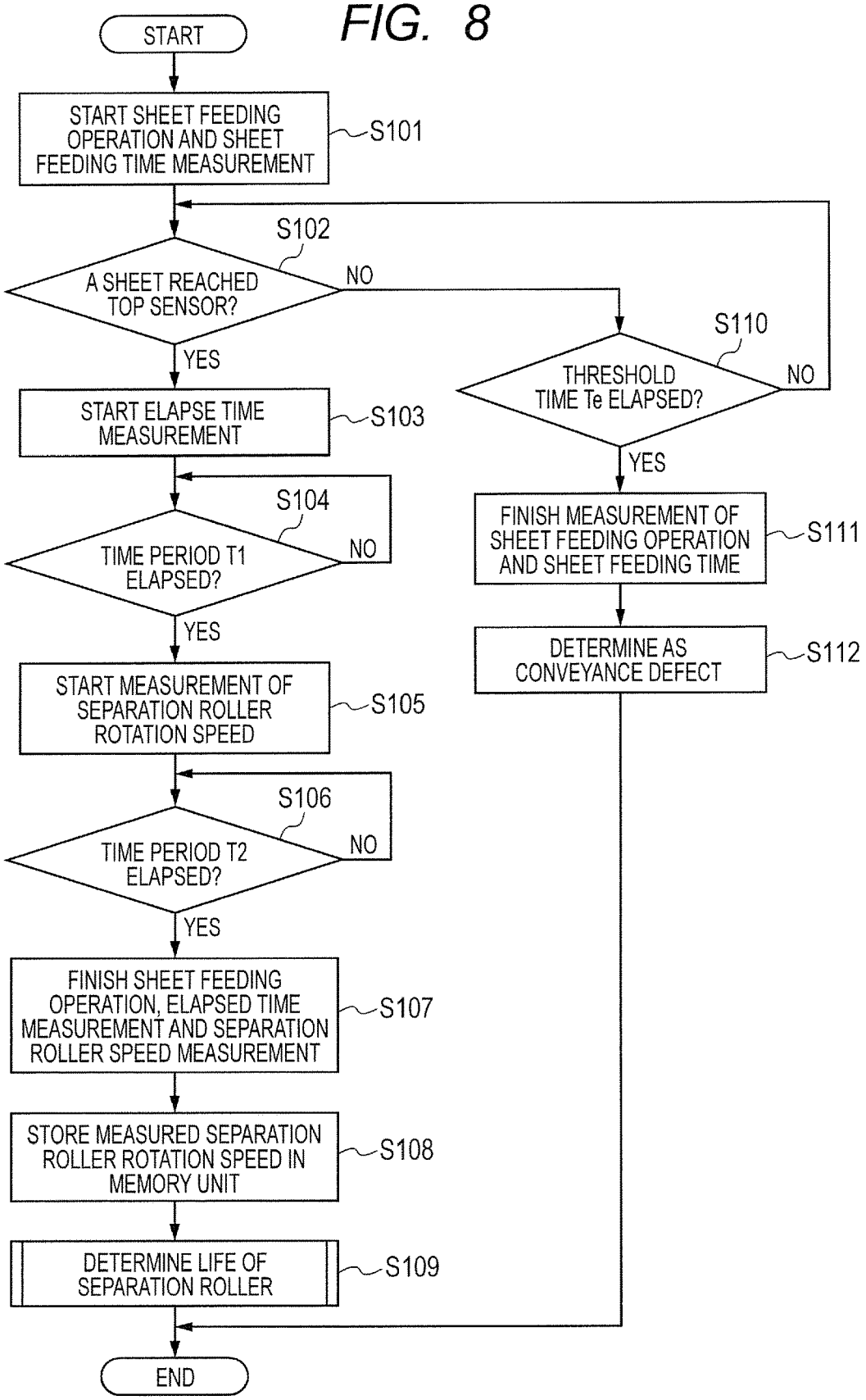
FIG. 8 is a flowchart for illustrating life condition determination processing for the separation roller in the first embodiment.
Figure 9:
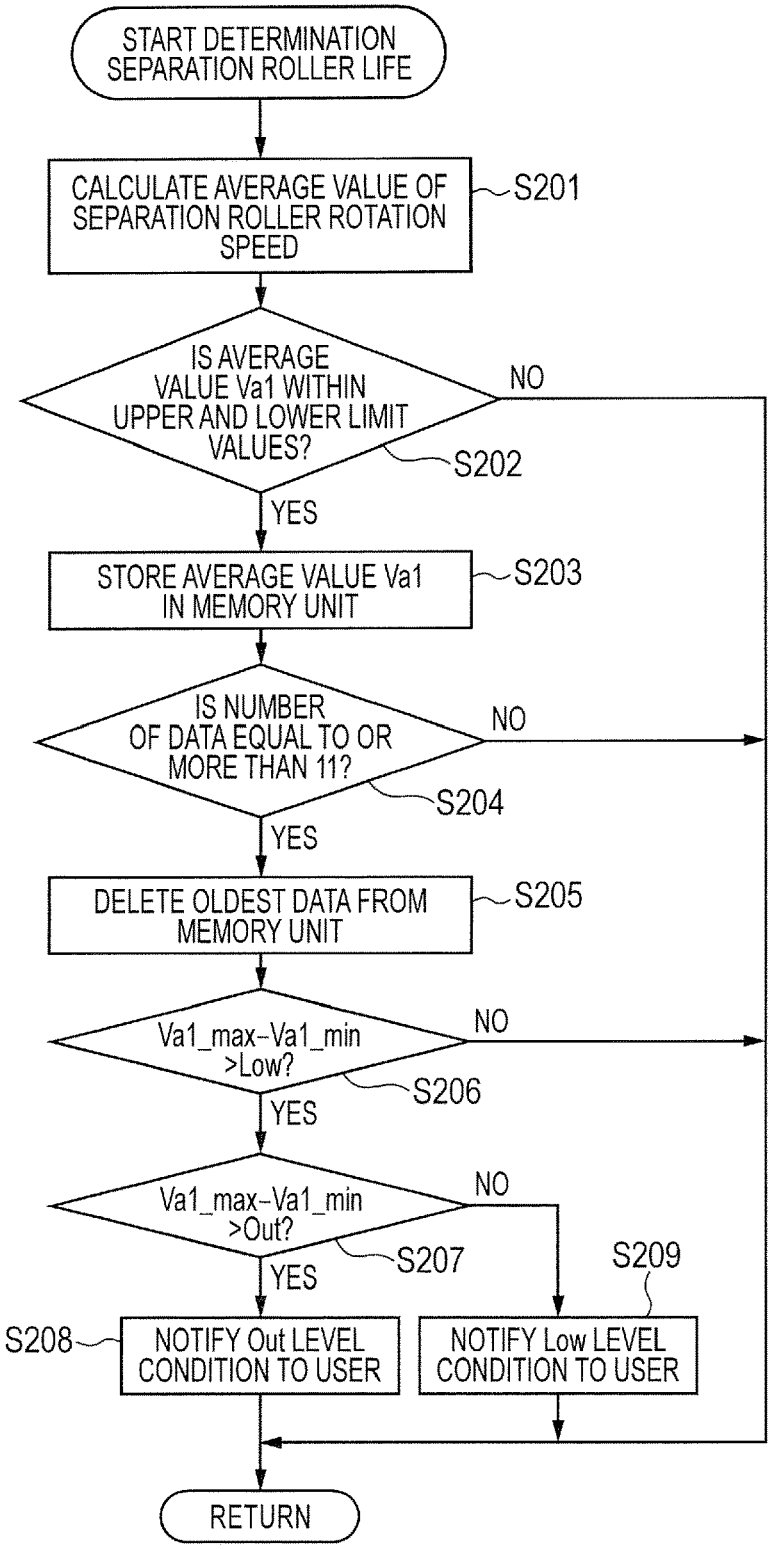
FIG. 9 is a flowchart for illustrating the life condition determination processing for the separation roller in the first embodiment.

With reference to flowcharts of FIG. 8 and FIG. 9, description is made of a determination method for a life condition of the separation roller 105 in the first embodiment. The control based on the flowcharts of FIG. 8 and FIG. 9 is executed by the engine control unit 201 provided to the control unit 200 based on a program stored in the memory unit 209 such as a ROM.

First, description is made with reference to FIG. 8. In the following, each step is indicated by "Step S". In Step S101, the engine control unit 201 transmits an instruction of starting a sheet feeding operation to the drive control unit 210 to start the sheet feeding operation. Further, the engine control unit 201 starts measurement of a sheet feeding time by the measurement unit 206. In Step S102, the engine control unit 201 determines whether or not a leading edge of the sheet S has been detected by the top sensor 108. The engine control unit 201 determines that the leading edge of the sheet S has been detected based on a state under which a signal output from the top sensor 108 is changed from OFF to ON. When the engine control unit 201 determines in Step S102 that the leading edge of the sheet S has been detected by the top sensor 108, the processing proceeds to Step S103. When the engine control 201 determines in Step S102 that the leading edge of the sheet S has not been detected by the top sensor 108, the processing proceeds to Step S110.

In Step S103, the engine control unit 201 starts measurement of an elapsed time from a timing at which the sheet S has arrived at the top sensor 108 by the measurement unit 206. In Step S104, the engine control unit 201 determines whether or not the elapsed time, which is measured by the measurement unit 206, from arrival of the leading edge of the sheet S to the top sensor 108 exceeds the time period T1. When the engine control unit 201 determines in Step S104 that the time period T1 has not elapsed, the processing returns to Step S104, and the elapsed time from arrival of the leading edge of the sheet S to the top sensor 108 is continuously measured by the measurement unit 206. When the engine control unit 201 determines in Step S104 that the time period T1 has elapsed, the processing proceeds to Step S105.

In Step S105, the engine control unit 201 starts measurement of the rotation speed of the separation roller 105 based on a rotation state of the separation roller 105 which is detected by the encoder 203. In Step S106, the engine control unit 201 determines whether or not the elapsed time of Step S103, which is being measured by the measurement unit 206, from arrival of the leading edge of the sheet S to the top sensor 108 exceeds the time period T2. When the engine control unit 201 determines in Step S106 that the time period T2 has not elapsed, the processing returns to Step S106, and the elapsed time from arrival of the leading edge of the sheet S to the top sensor 108 is continuously measured by the measurement unit 206. When the engine control unit 201 determines in Step S106 that the time period T2 has elapsed, the processing proceeds to Step S107.

In Step S107, the engine control unit 201 stops drive of the pick roller 103 by the drive control unit 210 to finish the sheet feeding operation, and finishes measurement of rotation speed of the separation roller 105 and measurement of elapsed time by the measurement unit 206. In Step S108, the engine control unit 201 stores the rotation speed of the separation roller 105, which has been measured by the measurement unit 206, in the memory unit 209. In Step S109, based on the rotation speed of the separation roller 105 which has been measured by the measurement unit 206, the engine control unit 201 determines the life condition of the separation roller 105 by the determination unit 207. Then, the processing is ended. The process of Step S109 is described later in detail.

In Step S110, the engine control unit 201 determines whether or not the sheet feeding time during measurement by the measurement unit 206 has exceeded a threshold time Te which is set for determination of a feeding defect. When the engine control unit 201 determines in Step S110 that the elapsed time has not exceeded the threshold time Te, the processing returns to Step S102, and drive of the pick roller 103 is maintained by the drive control unit 210 to continue the sheet feeding operation. When the engine control unit 201 determines in Step S110 that the elapsed time has exceeded the threshold time Te, the processing proceeds to Step S111. In Step S111, the engine control unit 201 stops drive of the pick roller 103 by the drive control unit 210 to finish the sheet feeding operation, and finishes measurement of the sheet feeding time by the measurement unit 206. In Step S112, the engine control unit 201 determines that conveyance defect such as delay erroneous printing has occurred, and notifies the occurrence of the conveyance defect to a user through the panel 211 or external equipment. Then, the processing is ended.

(Life Condition Determination Processing for Separation Roller 105)

Next, with reference to FIG. 9, description is made of life condition determination processing for the separation roller 105 in Step S109. In Step S201, the engine control unit 201 reads information of the rotation speed of the separation roller 105 which is stored in the memory unit 209. The engine control unit 201 calculates the average value Va1 of the rotation speed of the separation roller 105 in a period from a time at which the time period T1 has elapsed since the leading edge of the sheet S arrived at the top sensor 108 until a time at which the time period T2 has elapsed. In Step S202, the engine control unit 201 determines whether or not the average value Va1 of the rotation speed of the separation roller 105 which has been calculated in Step S201 falls within a range of an upper limit value and a lower limit value of the average values Va1 set in advance (hereinafter referred to as "within the upper and lower limit value range"). When the engine control unit 201 determines in Step S202 that the average value Va1 of the rotation speed of the separation roller 105 which has been calculated does not fall within the upper and lower limit value range, the life condition determination for the separation roller 105 is ended.

When the engine control unit 201 determines in Step S202 that the average value Va1 of the rotation speed of the separation roller 105 falls within the upper and lower limit value range set in advance, the processing proceeds to Step S203. In Step S203, the engine control unit 201 stores the average value Va1 of the rotation speed of the separation roller 105 which has been calculated in Step S201 in the memory unit 209. When the average value Va1 of the rotation speed of the separation roller 105 is to be stored in the memory unit 209, information of the time of storing the average value Va1 is also stored. In Step S204, the engine control unit 201 determines whether or not the number of items of data of the average values Va1 of the rotation speed of the separation roller 105 stored in the memory unit 209 is equal to or more than a predetermined number, for example, equal to or more than eleven. The number of items of data to be stored in the memory unit 209 is not limited to eleven.

When the engine control unit 201 determines in Step S204 that the number of items of data stored in the memory unit 209 is less than eleven, the life condition determination for the separation roller 105 is ended. When the engine control unit 201 determines in Step S204 that the number of items of data stored in the memory unit 209 is equal to or more than eleven, the processing proceeds to Step S205. In Step S205, the engine control unit 201 deletes one oldest item of data from the eleven items of data of the average values Va1 of the rotation speed of the separation roller 105 stored in the memory unit 209. In Step S206, the engine control unit 201 determines whether or not the life condition of the separation roller 105 is at the above-mentioned Low level. The engine control unit 201 extracts the maximum value Va1_max and the minimum value Va1_min from ten items of data of the average values Va1 stored in the memory unit 209, and obtains a difference between the maximum value Va1_max and the minimum value Va1_min. The engine control unit 201 determines whether or not the difference between the maximum value Va1_max and the minimum value Va1_min, that is, variation in average values Va1 of the rotation speed of the separation roller 105, is larger than a life threshold value Low being a first threshold value for determination of the Low level condition.

When the engine control unit 201 determines in Step S206 that the difference between the maximum value Va1_max and the minimum value Va1_min is equal to or less than the life threshold value Low (equal to or less than the first threshold value) and that variation in average values Va1 is smaller than the life threshold value Low, the life condition determination for the separation roller 105 is ended. When the engine control unit S201 determines in Step S206 that the difference between the maximum value Va1_max and the minimum value Va1_min is larger than the life threshold value Low, that is, variation in average values Va1 is larger than the life threshold value Low, the processing proceeds to Step S207.

In Step S207, the engine control unit 201 determines whether or not the difference between the maximum value Va1_max and the minimum value Va1_min is larger than a life threshold value Out being a second threshold value for determination of the above-mentioned Out level condition. The life threshold value Out is larger than the life threshold value Low. When the engine control unit 201 determines in Step S207 that the difference between the maximum value Va1_max and the minimum value Va1_min, that is, variation in average values Va1 is equal to or smaller than the life threshold value Out (equal to or smaller than the second threshold value), the processing proceeds to Step S209. In Step S209, the engine control unit 201 determines that the life condition of the separation roller 105 is the Low level condition, and notifies the Low level condition to a user through use of the panel 211 by the output unit 208. Then, the life condition determination for the separation roller 105 is ended. When the engine control unit 201 determines in Step S207 that the difference between the maximum value Va1_max and the minimum value Va1_min is larger than the life threshold value Out, that is, variation in average values Va1 is larger than the life threshold value Out, the processing proceeds to Step S208. In Step S208, the engine control unit 201 determines that the life condition of the separation roller 105 is the Out level condition, and notifies the Out level condition to a user through use of the panel 211 by the output unit 208. Then, the life condition determination for the separation roller 105 is ended.

The variation in average values Va1 of the rotation speed of the separation roller 105 corresponds to the difference between the maximum value and the minimum value of data stored in the memory unit 209. However, a standard deviation or an average value may be derived through calculation based on the data stored in the memory unit 209. The number of items of data of the average values Va1 of the rotation speed stored in the memory unit 209 may also be changed to an appropriate number of items of data depending on a calculation method for variation. Further, in order to prevent erroneous detection caused by unexpected abnormal data, the Low level and the Out level of the life condition of the separation roller 105 may be determined when variation in average values Va1 of the rotation speed of the separation roller 105 exceeds the threshold value a plurality of times within a predetermined period.

As described above, the influence of the diameter of the separation roller 105, variation in friction coefficient of a surface, and a kind of sheet S is minimized, and hence the life condition of the separation roller 105 including the sign indicating that the separation roller 105 reaches an end of life can be more accurately determined in a state before occurrence of the conveyance defect. A result of the life condition determination for the separation roller 105 is notified to a user to prompt replacement of the separation roller 105, thereby being capable of preventing in advance the conveyance defect such as erroneous printing which may occur in the future. Further, when an end of life of the separation roller 105 has not come, unnecessary replacement of the separation roller 105 is prevented, thereby being capable of reducing cost. As described above, according to the first embodiment, the life condition of the separation roller can be determined accurately.

Second Embodiment

A second embodiment of the present invention is described. Description regarding a main part is the same as that of the first embodiment, and hence only a part different from the first embodiment is described.

<Description of Sheet Feeding Control in Second Embodiment>

Figure 10A:
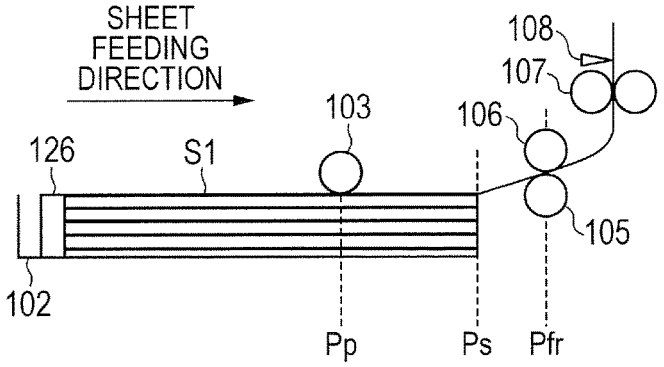
FIG. 10A, FIG. 10B, FIG. 10C, and FIG. 10D are explanatory views for illustrating an operation of sheet feeding control in the second embodiment.

First, a sheet feeding control of the printer 101 in the second embodiment is described with reference to FIG. 10A to FIG. 10D, FIG. 11A, and FIG. 11B. FIG. 10A to FIG. 10D correspond to FIG. 4A to FIG. 4D in the first embodiment, and FIG. 11A and FIG. 11B correspond to FIG. 5. Description related to FIG. 10A is the same as that of FIG. 4A, and the state illustrated in FIG. 10A corresponds to the timing Ta of FIG. 11A.

Figure 10B:
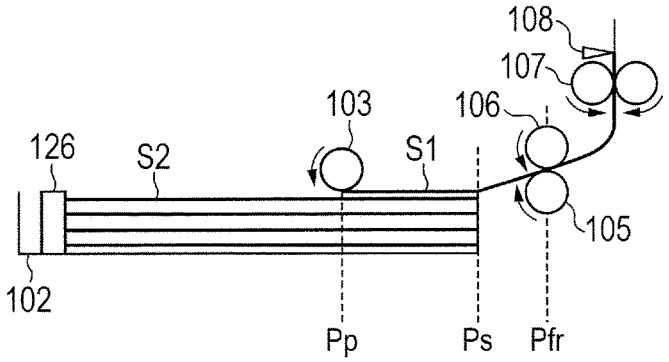

Next, FIG. 10B is a sectional view for illustrating the cassette 102 at a timing at which the trailing edge of the sheet S1 (end portion on the upstream side in the sheet feeding direction) has arrived at the position Pp of the nip portion of the pick roller 103. The printer 101 of the second embodiment employs a sheet feeding method of feeding a sheet S2, which is located below the sheet S1, under a state under which the sheet S2 partially overlaps with the sheet S1. Therefore, in the second embodiment, even at the timing at which the trailing edge of the sheet S1 has arrived at the position Pp of the nip portion of the pick roller 103, drive of the pick roller 103 is maintained in an ON state. After the trailing edge of the sheet S1 has passed through the pick roller 103, the pick roller 103 is brought into contact with the sheet S2 and feeds the sheet S2 in the rightward direction. The timing Tb in the graph of FIG. 11A corresponds to the state illustrated in FIG. 10B. At the timing Tb, drive of the pick roller 103 is maintained in the ON state, and the separation roller 105 is rotated so as to follow the sheet S1 being conveyed.

Figure 10C:
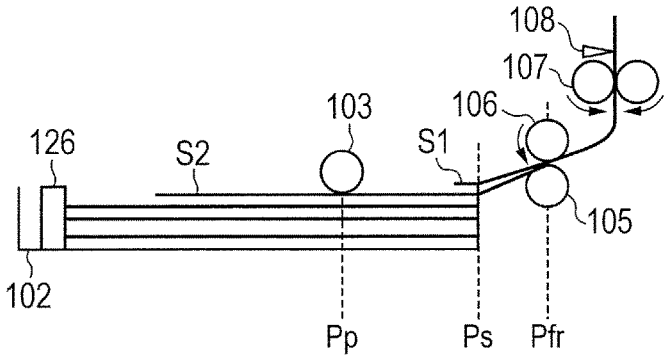

Next, FIG. 10C is a sectional view for illustrating the cassette 102 at a timing at which the leading edge of the sheet S2 being fed by the pick roller 103 has arrived at the position Pfr of the separation nip portion between the feed roller 106 and the separation roller 105. As described above, when one sheet S is conveyed, the separation roller 105 is rotated in the clockwise direction to feed the one sheet S. However, when two or more sheets S are conveyed, the separation roller 105 stops the rotation or is rotated in the counterclockwise direction to separate the two or more sheets S so that one sheet S is conveyed. That is, the rotation state of the separation roller 105 changes. The timing Tc in the graphs of FIG. 11A and FIG. 11B corresponds to the state illustrated in FIG. 10C. At the timing Tc, the leading edge of the sheet S2 has arrived at the position Pfr of the separation nip portion, and hence the rotation of the separation roller 105 is stopped. When the leading edge of the sheet S2 arrives at the position Pfr of the separation nip portion, in order to prevent a sheet jam caused by the sheet S2 pressed into the separation nip portion, drive of the pick roller 103 is switched from ON to OFF. Further, drive of the feed roller 106 is also switched to OFF, but the feed roller 106 is rotated so as to follow the sheet S1.

Figure 10D:
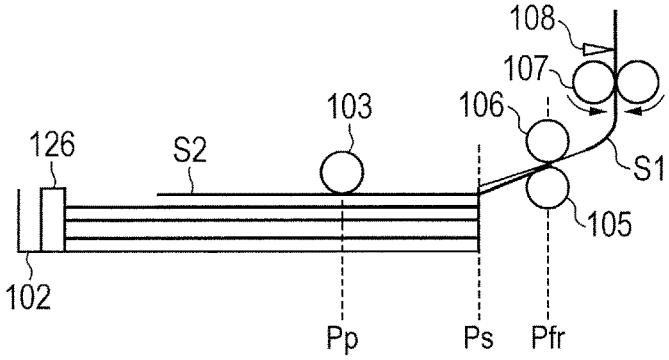

Next, FIG. 10D is a sectional view for illustrating the cassette 102 at a timing after the trailing edge of the sheet S1 has passed through a position Pfr of the separation nip portion between the feed roller 106 and the separation roller 105. The timing Td in each graph of FIG. 11A corresponds to the state illustrated in FIG. 10D. The sheet S1 has passed through the position Pfr of the separation nip portion, and hence rotation of the feed roller 106 is stopped.

As described above, in the printer 101 of the second embodiment, under the state under which the leading edge of the sheet S2 has arrived at the position Pfr of the separation nip portion, and rotation of the separation roller 105 is stopped or reversed, drive of the pick roller 103 is turned OFF. Further, under the state under which the rotation speed of the separation roller 105 has become lower than a certain threshold speed, drive of the pick roller 103 may be turned OFF before rotation of the separation roller 105 is stopped. The sheet S2 is fed in advance in a state of overlapping with the sheet S1, and hence the leading edge position of the sheet S2 can be aligned with the position Pfr of the separation nip portion. Such a sheet feeding method is hereinafter referred to as "preceding sheet feeding". Through the preceding sheet feeding, when the sheet feeding operation is continuously performed, a distance between the trailing edge of the sheet S1 and the leading edge of the sheet S2 (hereinafter referred to as "sheet-to-sheet distance") can be shortened. That is, the number of sheets to be printed per unit time and productivity of the printer 101 can be improved.

<Life Detection for Separation Roller in Second Embodiment>

Next, the influence on the sheet feeding control along with degradation in conveyance performance due to abrasion or the like of the separation roller 105 is described with reference to FIG. 11B. FIG. 11B is a graph for showing a state under which the conveyance performance of the separation roller 105 is degraded in the graph of FIG. 11A. When a friction force of the separation roller 105 with respect to the sheet S is reduced, and the separation roller 105 cannot be correctly driven to rotate with respect to the sheet S, even when one sheet S is conveyed to the separation nip portion between the feed roller 106 and the separation roller 105, the rotation of the separation roller 105 may be stopped. When the rotation of the separation roller 105 is stopped at the timing Tc due to degradation in conveyance performance of the separation roller 105, the engine control unit 201 determines that the rotation of the separation roller 105 is stopped due to arrival of the leading edge of the sheet S2 to the position Pfr of the separation nip portion. In such a case, the engine control unit 201 turns OFF the drive of the pick roller 103. The drive of the pick roller 103 is turned OFF at the timing Tc, and hence the sheet S2 is not further fed. That is, in this case, the leading edge of the sheet S2 is not fed to the position Pfr of the separation nip portion.

As described above, the leading edge of the sheet S2 does not arrive at the position Pfr of the separation nip portion, and hence the separation roller 105 is continuously driven to rotate so as to follow the sheet S1 being conveyed by the registration roller pair 107 even after the drive of the pick roller 103 is turned OFF. At the timing Td, when the sheet S1 has passed through the position Pfr of the separation nip portion, the driven rotation of the separation roller 105 is stopped. In this case, the sheet-to-sheet distance between the sheet S1 and the sheet S2 cannot be shortened, with the result that the productivity of the printer 101 is degraded.

Figure 11A:
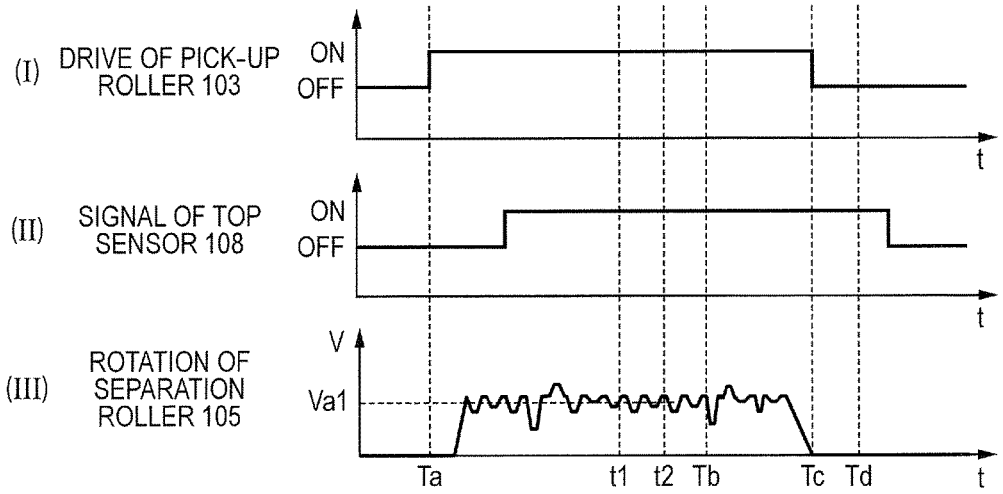
FIG. 11A and FIG. 11B are timing charts of a case in which the sheet feeding control in the second embodiment is executed.
Figure 11B:
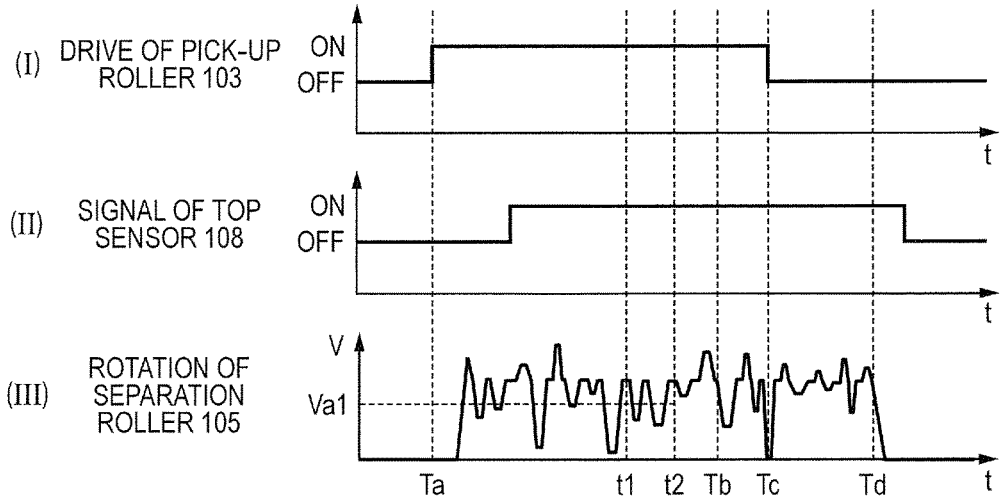

In summary, in FIG. 11A, there is shown a state under which the leading edge of the sheet S2 has arrived at the position Pfr of the separation nip portion and the drive of the pick roller 103 is turned OFF so that successful preceding sheet feeding is performed. In FIG. 11A, rotation of the separation roller 105 is stopped after the timing Tc. Further, in FIG. 11B, there is shown a state under which the drive of the pick roller 103 is turned OFF due to the degradation in conveyance performance of the separation roller 105 so that erroneous preceding sheet feeding is performed. In FIG. 11B, the rotation of the separation roller 105 is maintained after the timing Tc. That is, through monitoring of whether or not the rotation of the separation roller 105 continues after the drive of the pick roller 103 is stopped, determination can be made on whether the preceding sheet feeding is successful or erroneous. Thus, in addition to the variation in average values Va1 of the rotation speed of the separation roller 105, through monitoring of the number of errors in preceding sheet feeding of the sheet S2 due to degradation in conveyance performance of the separation roller 105, the life condition of the separation roller 105 can be more accurately determined.

<Determination Processing for Life Condition>

Figure 12:
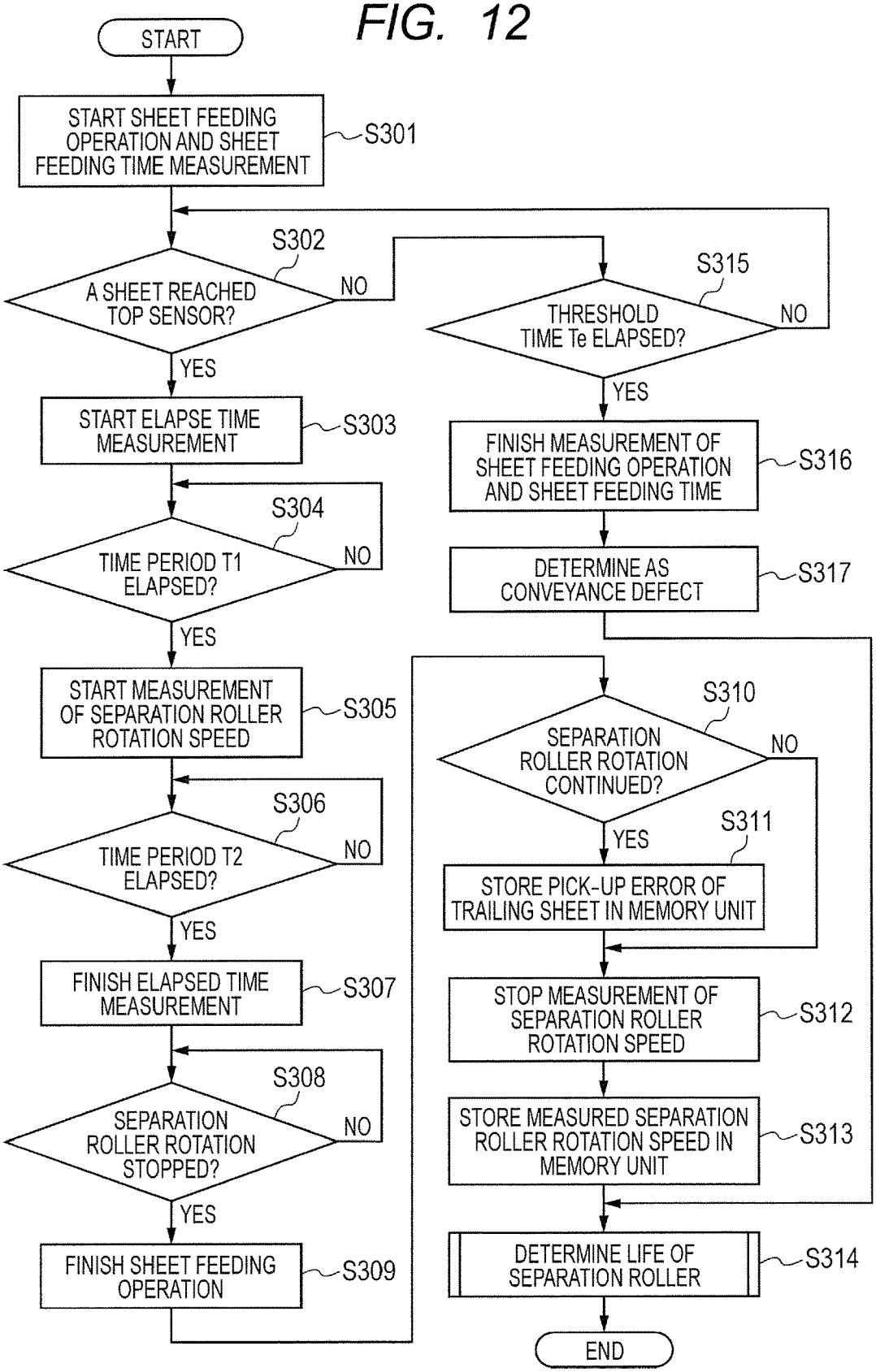
FIG. 12 is a flowchart for illustrating life condition determination processing for the separation roller in the second embodiment.
Figure 13:
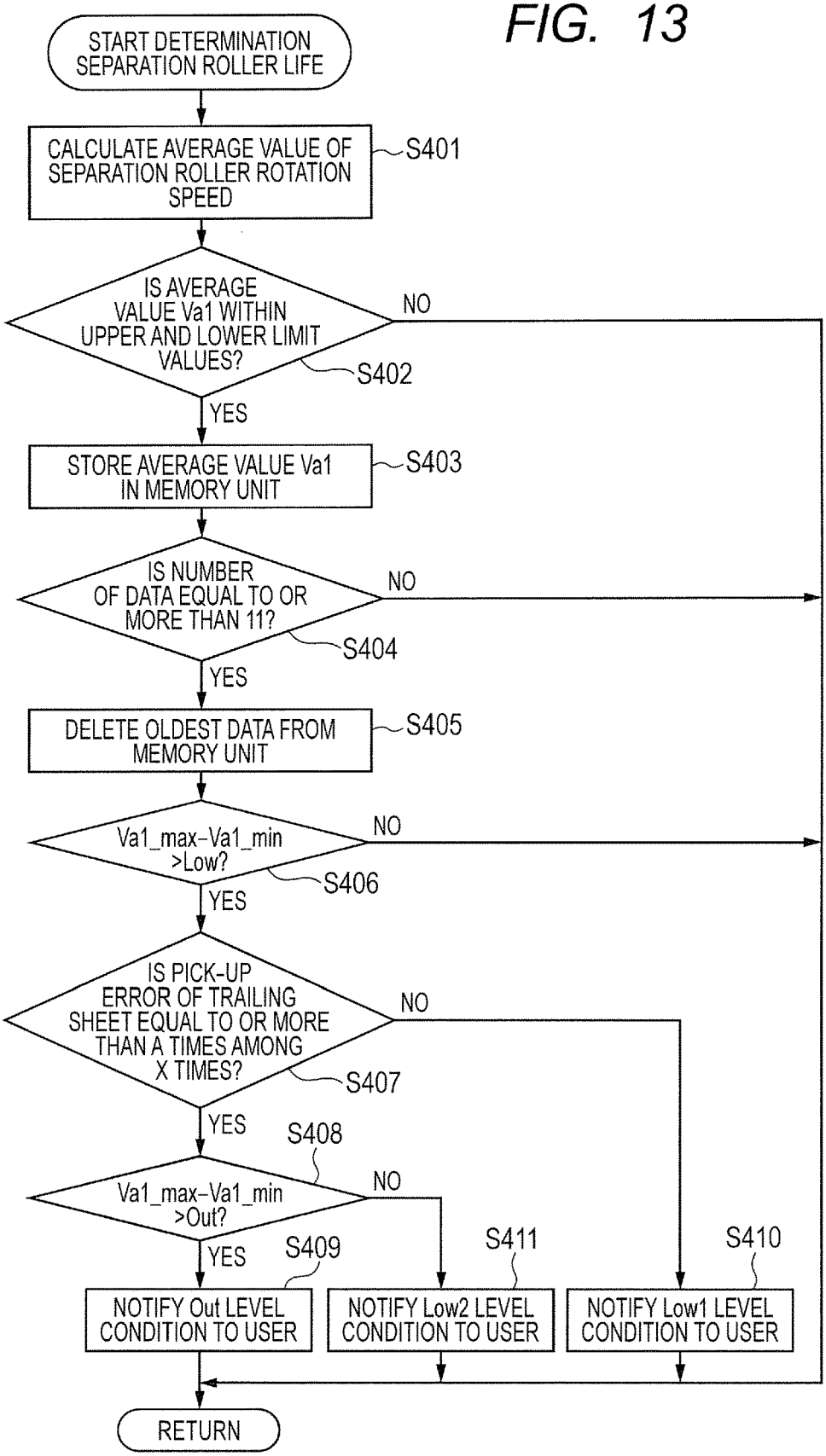
FIG. 13 is a flowchart for illustrating the life condition determination processing for the separation roller in the second embodiment.

With reference to flowcharts of FIG. 12 and FIG. 13, description is made of a determination method for a life condition of the separation roller 105 in the second embodiment. In FIG. 12, the processes of Step S301 to Step S306 are the same as the processes of Step S101 to Step S106 in FIG. 8, and hence description thereof is omitted. When the measurement time exceeds the time period T2 in Step S306, the engine control unit 201 finishes measurement of the elapsed time by the measurement unit 206 in Step S307. Similarly to the first embodiment, in the second embodiment, the rotation speed of the separation roller 105 can be measured while avoiding the timing at which the rotation of the separation roller 105 is liable to change. The measurement of the rotation speed of the separation roller 105 for obtaining the average values Va1 of the rotation speed of the separation roller 105 is finished in accordance with the measurement time exceeding the time period T2. However, in the second embodiment, in order to monitor whether the rotation of the separation roller 105 is continued or is stopped, the measurement of the rotation speed of the separation roller 105 by the measurement unit 206 is continued even after the measurement time exceeds the time period T2.

In Step S308, based on the rotation speed of the separation roller 105 being measured by the measurement unit 206, the engine control unit 201 determines whether or not the rotation of the separation roller 105 is stopped. When it is determined in Step S308 that the rotation of the separation roller 105 is not stopped but continued, the processing returns to Step S308, and the measurement of the rotation speed of the separation roller 105 is continued. When the engine control unit 201 determines in Step S308 that the rotation of the separation roller 105 is stopped, the processing proceeds to Step S309. In Step S309, the engine control unit 201 stops drive of the pick roller 103 by the drive control unit 210. Then, the feeding operation is finished.

In Step S310, the engine control unit 201 determines whether or not the rotation of the separation roller 105 is continued even after the feeding operation has been finished. When the engine control unit 201 determines in Step S310 that the rotation of the separation roller 105 is not continued, that is, the rotation of the separation roller 105 remains being stopped, the processing proceeds to Step S312. When the engine control unit 201 determines in Step S310 that the rotation of the separation roller 105 is continued, the engine control unit 201 determines that the preceding sheet feeding for the trailing sheet S2 is erroneous, and the processing proceeds to Step S311. In Step S311, the engine control unit 201 stores in the memory unit 209 the information indicating that the preceding sheet feeding for the trailing sheet S2 is erroneous. In Step S312, the engine control unit 201 finishes the measurement of the rotation speed of the separation roller 105 by the measurement unit 206. The process of Step S313 is the same as the process of Step S108 in FIG. 8, and description thereof is omitted. In Step S314, based on the rotation speed of the separation roller 105 which has been measured by the measurement unit 206, the engine control unit 201 determines the life condition of the separation roller 105 by the determination unit 207. The process of Step S314 is described later in detail. The processes of Step S315 to Step S317 in FIG. 12 are the same as the processes of Step S110 to Step S112 in FIG. 8, and description thereof is omitted.

(Life Condition Determination Processing for Separation Roller 105)

Next, with reference to FIG. 13, description is made of life condition determination processing for the separation roller 105 in Step S314. The processes of Step S401 to Step S406 in FIG. 13 are the same as the processes of Step S201 to Step S206 in FIG. 9, and description thereof is omitted. When the engine control unit 201 determines in Step S406 that variation in average values Va1 is larger than the life threshold value Low, the processing proceeds to Step S407. In Step S407, the engine control unit 201 reads information of erroneous preceding sheet feeding stored in the memory unit 209. Based on the information of erroneous preceding sheet feeding having been read, the engine control unit 201 determines whether or not, among X times being a predetermined number of the sheet feeding operation having been performed, the number of errors in preceding sheet feeding of the sheet S2 is equal to or larger than a threshold number A (≤X) being a predetermined frequency (equal to or larger than a predetermined frequency).

When the engine control unit 201 determines in Step S407 that the number of errors in preceding sheet feeding is smaller than the threshold value number A, the processing proceeds to Step S410. In Step S410, the engine control unit 201 determines that the life condition of the separation roller 105 is a Low1 level condition being a second condition, and notifies the Low1 level to a user. After that, the life condition determination for the separation roller 105 is ended. The life condition Low1 level is a condition which is further classified from the Low level condition described in the first embodiment. The Low1 level is a condition before reaching a Low2 level, and is not at a level at which the conveyance defect caused by degradation in conveyance performance of the separation roller 105 occurs frequently and is a condition in which the productivity is not degraded.

When the engine control unit 201 determines in Step S407 that the number of errors in preceding sheet feeding is equal to or larger than the threshold number A, the processing proceeds to Step S408. In Step S408, the engine control unit 201 determines whether or not the life condition of the separation roller 105 is the above-mentioned Out level condition. When the engine control unit 201 determines in Step S408 that variation in average values Va1 of the rotation speed of the separation roller 105 is equal to or smaller than the life threshold value Out, the processing proceeds to Step S411. The engine control unit 201 determines in Step S411 that the life condition of the separation roller 105 is a Low2 level condition being a first condition, and notifies the Low2 level condition to a user. Then, the life condition determination for the separation roller 105 is ended. The Low2 level is not at a level at which the conveyance defect caused by degradation in conveyance performance of the separation roller 105 occurs frequently but is a condition in which the productivity is degraded due to occurrence of error in preceding sheet feeding.

When the engine control unit 201 determines in Step S408 that variation in average values Va1 of the rotation speed of the separation roller 105 is larger than the life threshold value Out, the processing proceeds to Step S409. In Step S409, the engine control unit 201 determines that the life condition of the separation roller 105 is the Out level condition, and notifies the Out level condition to a user. Then, the life condition determination for the separation roller 105 is ended. In the second embodiment, for example, in order to separate the Low1 level condition and the Low2 level condition, conditions of X=10 and A=2 are set. That is, when the sheet feeding operation is performed ten times, the Low1 level condition and the Low2 level condition are separated depending on whether or not the number of errors in preceding sheet feeding stored in the memory unit 209 is equal to or larger than two. In the second embodiment, based on a frequency of occurrence of a phenomenon in which the separation roller 105 is stopped and thereafter rotated again when feeding is performed a plurality of times, the life condition of the separation roller 105 is determined.

From the description above, the second embodiment has the following effect in addition to the effect of the first embodiment. According to the second embodiment, in the image forming apparatus which involves sheet feeding control of performing preceding sheet feeding of aligning the leading edge position of the trailing sheet S2 to the separation nip portion, the life condition of the separation roller 105 is determined in accordance with variation in average values Va1 of the rotation speed of the separation roller 105. Further, according to the second embodiment, through monitoring of errors in preceding sheet feeding caused by degradation in conveyance performance of the separation roller 105, the life condition of the separation roller 105 including the influence on the productivity due to degradation in conveyance performance of the separation roller 105 can be more accurately determined. In the sheet feeding configuration of the second embodiment, the processes related to the number of errors in preceding sheet feeding may be omitted, and the control which is the same as the control in the first embodiment may be performed.

In the first and second embodiments described above, description is made on the assumption that the conveyance speed of the sheet (process speed) does not change when different kinds of sheets are conveyed. However, the present invention is applicable to a configuration in which the conveyance speed of the sheet changes. For example, it is assumed that a normal sheet is conveyed at a 1/1 speed, and a thick sheet is conveyed at a 1/3 speed. In this case, when the sheet stored in the cassette 102 is changed from the normal sheet to the thick sheet in midway, although the separation roller 105 has not reached an end of life, the rotation speed of the separation roller 105 changes in accordance with the conveyance speed of the sheet, with the result that the rotation speed of the separation roller 105 varies in appearance. As a result, there is a possibility that the separation roller 105 is erroneously determined as having reached the end of its life. Therefore, when the conveyance speed of the sheet changes, the rotation speed of the separation roller 105 having been detected is to be corrected in accordance with a reference speed. For example, the rotation speed of the separation roller 105 having been detected in a case in which the sheet is conveyed at the 1/3 speed is corrected to be threefold in accordance with the reference speed (1/1 speed).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-021297, filed Feb. 8, 2017, and Japanese Patent Application No. 2017-246425, filed Dec. 22, 2017, which are hereby incorporated by reference herein in their entirety.

What is claimed is:

1. A feeding apparatus comprising:

a feeding rotary member configured to feed a recording material;

a conveyance rotary member configured to convey the recording material fed by the feeding rotary member;

a separation rotary member configured to form a nip portion with the conveyance rotary member and configured to separate a plurality of recording materials one by one at the nip portion;

an output unit configured to output a signal according to a rotation state of the separation rotary member; and a control unit configured to determine a life of the separation rotary member based on variation in rotation speed of the separation rotary member corresponding to the signal output from the output unit.

2. The feeding apparatus according to claim 1, wherein in a case where a first recording material is fed to the nip portion, the separation rotary member is rotated in a predetermined direction by the first recording material, and in a case where the first recording material and a second recording material are fed into the nip portion in an overlapping state, the separation rotary member stops in rotation or rotates in a direction opposite to the predetermined direction so as to separate the first recording material and the second recording material, and wherein the control unit determines the life of the separation rotary member based on variation in rotation speed of the separation rotary member during a predetermined period in which the separation rotary member is rotated in the predetermined direction under a state in which the first recording material is fed to the nip portion.

3. The feeding apparatus according to claim 2, further comprising a memory unit configured to store information, wherein the control unit is configured to obtain average values, each of the average values being an average value of rotation speeds of the separation rotary member in the predetermined period, store the average values in the memory unit, obtain a maximum value of the average value and a minimum value of the average value from among the average values stored in the memory unit, and define the variation in rotation speed of the separation rotary member as a difference between the maximum value and the minimum value.

4. The feeding apparatus according to claim 3, wherein in a case where the difference is equal to or less than a first threshold value, the control unit determines that the separation rotary member has not reached an end of life.

5. The feeding apparatus according to claim 4, wherein in a case where the difference is greater than a second threshold value which is greater than the first threshold value, the control unit determines that the separation rotary member has reached the end of life.

6. The feeding apparatus according to claim 5, wherein when the difference is greater than the first threshold value and is equal to or less than the second threshold value, the control unit determines that the separation rotary member is about to reach the end of life.

7. The feeding apparatus according to claim 3, wherein in a case where the average value does not fall within a predetermined range, the control unit is inhibited from determining the life of the separation rotary member.

8. The feeding apparatus according to claim 3, wherein the control unit is inhibited from determining the life of the separation rotary member until the number of average values stored in the memory unit reaches a predetermined number.

9. The feeding apparatus according to claim 2, wherein the feeding rotary member feeds the first recording material provided at an uppermost position in a stacking portion, and feeds the second recording material provided below the first recording material to partially overlap the first recording material after a trailing edge of the first recording material passes through the feeding rotary member, and wherein the control unit controls a feeding operation by the feeding rotary member based on the rotation speed of the separation rotary member corresponding to the signal from the output unit, and stops the feeding operation in a state where a leading edge of the second recording material has reached the nip portion.

10. The feeding apparatus according to claim 9, wherein in a case where the rotation speed of the separation rotary member corresponding to the signal from the output unit is faster than a threshold speed, the control unit continues the feeding operation to perform the feeding operation for the second recording material following the feeding operation for the first recording material, and in a case where the rotation speed of the separation rotary member corresponding to the signal from the output unit is slower than the threshold speed, the control unit instructs to stop the feeding operation to stop the second recording material in the state where the leading edge of the second recording material reaches the nip portion before the separation rotary member stops in rotation.

11. The feeding apparatus according to claim 10, wherein the control unit determines the life of the separation rotary member based on the variation in rotation speed of the separation rotary member and a frequency of occurrence of a phenomenon in which rotation of the separation rotary member continues after the instruction to stop the feeding operation.

12. The feeding apparatus according to claim 2, further comprising a detection unit configured to detect each of the plurality of recording materials conveyed by the conveyance rotary member, wherein the predetermined period is set based on a timing at which the detection unit detects a leading edge of the first recording material.

13. The feeding apparatus according to claim 1, further comprising a display unit configured to display a result of the determination by the control unit.

14. The feeding apparatus according to claim 1, wherein the output unit is coaxially provided with the separation rotary member, the output unit including a code wheel that rotates together with the separation rotary member, and wherein the output unit outputs the signal in accordance with the rotation state of the code wheel.

15. The feeding apparatus according to claim 1, further comprising:

a motor; and an electromagnetic clutch configured to transmit or cut off a drive force from the motor to the feeding rotary member and the conveyance rotary member, wherein in a case where the control unit instructs to start a feeding operation, the electromagnetic clutch transmits the drive force from the motor to the feeding rotary member and the conveyance rotary member, and wherein in a case where the control unit instructs to stop the feeding operation, the electromagnetic clutch cuts off the drive force from the motor with respect to the feeding rotary member and the conveyance rotary member.

16. The feeding apparatus according to claim 15, further comprising a torque limiter having one end is fixed, the torque limiter configured to apply a load to the separation rotary member, wherein in a case where a first recording material is fed to the nip portion, the load yields to a force received from the first recording material, and wherein in a case where the first recording material and a second recording material are fed to the nip portion in an overlapping state, the load yields to a force received from the second recording material.

17. A feeding apparatus comprising:

a feeding rotary member configured to individually feed a plurality of recording materials stacked on a stacking portion, wherein the feeding rotary member feeds a first recording material provided at an uppermost position in the stacking portion, and feeds a second recording material provided below the first recording material to partially overlap the first recording material after a trailing edge of the first recording material passes through the feeding rotary member;

a conveyance rotary member configured to convey each of the plurality of the recording materials fed by the feeding rotary member;

a separation rotary member configured to form a nip portion with the conveyance rotary member, wherein in a case where the first recording material is fed to the nip portion, the separation rotary member is rotated in a predetermined direction by the first recording material, and in a case where the first recording material and the second recording material are fed to the nip portion in an overlapping state, the separation rotary member stops in rotation or rotates in a direction opposite to the predetermined direction so as to separate the first recording material and the second recording material;

an output unit configured to output a signal according to a rotation state of the separation rotary member; and a control unit configured to control a feeding operation by the feeding rotary member based on a rotation speed of the separation rotary member corresponding to the signal from the output unit, and stop the feeding operation in a state where a leading edge of the second recording material has reached the nip portion, wherein the control unit determines a life of the separation rotary member based on the rotation speed of the separation rotary member corresponding to the signal output from the output unit.

18. The feeding apparatus according to claim 17, wherein in a case where the rotation speed of the separation rotary member corresponding to the signal from the output unit is faster than a threshold speed, the control unit continues the feeding operation to perform the feeding operation for the second recording material following the feeding operation for the first recording material, and in a case where the rotation speed of the separation rotary member corresponding to the signal from the output unit is slower than the threshold speed, the control unit instructs to stop the feeding operation to stop the second recording material in the state where the leading edge of the second recording material reaches the nip portion before the separation rotary member stops in rotation.

19. The feeding apparatus according to claim 17, further comprising a display unit configured to display a result of the determination by the control unit.

20. The feeding apparatus according to claim 17, wherein the output unit is coaxially provided with the separation rotary member, the output unit including a code wheel that rotates together with the separation rotary member, and wherein the output unit outputs the signal in accordance with the rotation state of the code wheel.

21. The feeding apparatus according to claim 17, further comprising:

a motor; and an electromagnetic clutch configured to transmit or cut off a drive force from the motor to the feeding rotary member and the conveyance rotary member, wherein in a case where the control unit instructs to start the feeding operation, the electromagnetic clutch transmits the drive force from the motor to the feeding rotary member and the conveyance rotary member, and wherein in a case where the control unit instructs to stop the feeding operation, the electromagnetic clutch cuts off the drive force from the motor with respect to the feeding rotary member and the conveyance rotary member.

22. The feeding apparatus according to claim 21, further comprising a torque limiter having one end being fixed, the torque limiter being configured to apply a load to the separation rotary member, wherein in a case where the first recording material is fed to the nip portion, the load yields to a force received from the first recording material, and wherein in a case where the first recording material and the second recording material are fed to the nip portion in an overlapping state, the load yields to a force received from the second recording material.

* * * * *